US006368424B1

(12) United States Patent
Sakai et al.

(10) Patent No.: US 6,368,424 B1
(45) Date of Patent: Apr. 9, 2002

(54) GRAIN-ORIENTED ELECTRICAL STEEL SHEETS HAVING EXCELLENT MAGNETIC CHARACTERISTICS, ITS MANUFACTURING METHOD AND ITS MANUFACTURING DEVICE

(75) Inventors: Tatsuhiko Sakai; Naoya Hamada; Katsuhiro Minamida, all of Futtsu; Kimihiko Sugiyama, Kitakyushu; Akira Sakaida, Kitakyushu; Hisashi Mogi, Kitakyushu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/125,574

(22) PCT Filed: Jan. 26, 1998

(86) PCT No.: PCT/JP98/00303

§ 371 Date: Aug. 20, 1998

§ 102(e) Date: Aug. 20, 1998

(87) PCT Pub. No.: WO98/32884

PCT Pub. Date: Jul. 30, 1998

(30) Foreign Application Priority Data

Jan. 24, 1997 (JP) ..... 9-011718
Apr. 24, 1997 (JP) ..... 9-107748

(51) Int. Cl.[7] ..... H01F 1/04
(52) U.S. Cl. ..... 148/111; 148/113; 148/120; 219/121.6; 219/121.85

(58) Field of Search ..... 148/306, 308, 148/111, 113, 120; 428/611; 219/121.6, 121.85

(56) References Cited

U.S. PATENT DOCUMENTS 4,468,551 A * 8/1984 Neiheisel ..... 219/121

FOREIGN PATENT DOCUMENTS

| | | |
|---|---|---|
| JP | 59-33802 | 2/1984 |
| JP | 6-57335 | 3/1994 |
| JP | 7-90385 | 4/1995 |

* cited by examiner

*Primary Examiner*—John Sheehan
*Assistant Examiner*—Andrew L. Oltmans
(74) *Attorney, Agent, or Firm*—Kenyon & Kenyon

(57) ABSTRACT

A grain-oriented electrical steel sheet with improved magnetic properties is achieved by a reduced 180° C. magnetic wall spacing with pulse laser light irradiation. The rolling direction width of the periodic closure domain generated by laser irradiation is no greater than 150 $\mu$m. The depth of the periodic closure domain in the direction of the steel sheet thickness is at least 30 $\mu$m. The product of the length of the periodic closure domain in the rolling direction width direction multiplied by the length of the depth of the periodic closure domain in the direction of the steel sheet thickness is at least 4500 $\mu m^2$. The magnetostriction with materials of 0.23 mm sheet thickness ($\lambda$19 p-p compression) is no greater than $0.9\times10^{-6}$, and magnetostriction with materials of 0.27 mm sheet thickness ($\lambda$19 p-p compression) is no greater than $1.3\times10^{-6}$.

8 Claims, 18 Drawing Sheets

(PRIOR ART METHOD)

(PRESENT INVENTION)

GRAIN-ORIENTED ELECTRICAL STEEL SHEETS HAVING EXCELLENT MAGNETIC CHARACTERISTICS, ITS MANUFACTURING METHOD AND ITS MANUFACTURING DEVICE

TECHNICAL FIELD

The present invention relates to a grain-oriented electrical steel sheets with magnetic properties improved by laser beam irradiation, and particularly it relates to a grain-oriented electrical steel sheets which has improved magnetic properties without laser irradiation damage generated on the steel sheet surface, as well as to a process for its production and an apparatus for realizing it.

BACKGROUND ART

Among conventional processes for producing a grain-oriented electrical steel sheets there have been proposed a variety of processes whereby dynamic deformation is introduced into the steel sheet surface, and a periodic closure domain is generated for fragmentation of the 180° magnetic domain, to reduce iron loss. Among these are processes such as disclosed in Japanese Unexamined Patent Publication No. 55-18566 whereby the surface of a steel sheet is irradiated with a focused pulse YAG laser beam to introduce deformation by the evaporation counterforce of the film on the steel sheet surface, and these processes produce a grain-oriented electrical steel sheets of exceedingly high reliability and controllability because they provide a considerable improving effect on iron loss and involve non-contact working.

However, although methods which employ pulse lasers have the advantage of effectively achieving glass film evaporation counterforce on steel sheet surfaces, they leave laser irradiation damage due to breakage of the surface insulation coating. This has led to the inconvenience of requiring an insulation coating to be provided after laser irradiation.

Different methods have therefore been disclosed for minimizing damage to glass films by using continuous-wave lasers with relatively low instantaneous power, such as the technique using a continuous-wave $CO_2$ laser described in Japanese Examined Patent Publication No. 62-49322 and the technique using a continuous-wave YAG laser described in Japanese Examined Patent Publication No. 5-32881. Particularly, in the specification relating to the latter patent it is clearly stated that since a Q-switched YAG laser has a short pulse time width and a high peak power, it is impossible to avoid evaporation and irradiation damages on glass films, so that it is not suitable for laser treatment of grain-oriented electrical steel sheets. It has also become evident that normal pulse lasers used for pulse lamp excitation and the like are unsuitable for laser treatment of grain-oriented electrical steel sheets, for the following reasons. The first reason is that, because this type of laser essentially has a very low pulse repetition rate, it cannot keep up with high-speed production lines. Another reason is that, when this type of laser is used, the average energy density on the irradiation side must be increased above that of a Q-switched pulse laser in order to achieve the necessary magnetic domain control. Increasing the average energy density on the irradiation side creates a new problem of physical deformation of the flatness of the steel sheet. Such deformation manifests itself as warping of the steel sheet and/or formation of streaks on the surface. It is stated that these streaks are detrimental to iron loss of the pulse laser-treated steel sheet, as well as detrimental to layered elements of transformers made from such pulse laser-treated steel sheets.

Incidentally, the principle of introducing deformation with a continuous-wave laser without leaving irradiation traces is based on rapid heating and rapid cooling of the steel sheet by laser irradiation. This is a major difference compared to the deformation source by the pulse laser method, which is the evaporation counterforce of the glass film.

However, while continuous-wave lasers can effectively control irradiation damages because of their low power density, their ability to achieve rapid heating and rapid cooling is lower compared to high peak power pulse lasers, resulting in lower efficiency for the introduction of deformation. Thus, in order to obtain the same improvement in iron loss through introduction of deformation as by pulse laser methods, it is necessary for the total irradiation energy on the steel sheet to be relatively higher. Incidentally, the magnetostriction of a grain-oriented steel sheet is a property which is proportional to the noise produced during its use as a transformer, and is as important a quality for grain-oriented electrical steel sheets as iron loss. In the case of laser magnetic domain control, it has been found that magnetostriction has a positive correlation with the total irradiation energy, and therefore magnetic domain control methods by continuous-wave lasers present a problem of greater magnetic deformation compared to pulse laser methods, which is a drawback of continuous-wave laser methods despite their negligible generation of irradiation damages.

In addition, when the presence of surface irradiation damages is examined closely, the phenomenon is found to be largely dependent on the irradiation power density which is determined by the beam shape and the laser power. It is therefore possible to control irradiation damages by reducing the power density. A minimum total heat input must be ensured, however, in order to produce sufficient heat deformation. With such conventional continuous-wave laser irradiation apparatuses, the heat input may be ensured by forming the laser beam as an oval with long axis in the direction of the steel sheet width, which is the scanning direction, and prolonging the time during which the laser beam is irradiated on the irradiation point. Consequently, when using irradiation apparatuses which minimize laser irradiation damages and have adjustable heat input, it has been necessary to achieve complex and precise control over the irradiation conditions, namely the laser power, scanning speed and oval beam shape.

Incidentally, the production steps for grain-oriented electrical steel sheets include annealing and insulation coating, and the steel sheet surfaces therefore comprise the oxide film formed during annealing as well as an insulation/rustproof coating applied thereover. As a result, the laser light resistance of the steel sheet surface varies minutely depending on the annealing temperature and time and on the type of coating solution. In order to minimize laser irradiation damages, therefore, it is necessary to adjust each of the laser irradiation conditions in accordance with the surface properties of the steel sheet. Among the irradiation conditions, the laser power can be controlled by the power adjusting function of the laser apparatus. The scanning speed can be easily controlled by adjusting the rotation speed of a polygon mirror or galvano mirror, which are commonly used in scanning optical systems. However, when the laser power is reduced to minimize irradiation damages, the accompanying reduction in incident heat results in insufficient introduction of deformation, and thus poorer iron loss properties. Lowering the scanning speed may therefore be considered, but this introduces the problem of a sacrifice in processing speed. Consequently, control of the laser power intensity has required control apparatuses which can be flexibly adapted not only for different laser powers and scanning speeds, but also for oval beam shapes.

In conventional irradiation apparatuses, as disclosed in the aforementioned Japanese Examined Patent Publication No. 5-32881, the laser beam focusing device is a simple cylindrical lens. With such focusing devices it is only possible to adjust oval beams in the short axis direction, and no modification can be made to the size of the beam irradiated from the laser apparatus in its long axis direction. Free and precise adjustment of oval shapes has therefore been impossible. Consequently, the prior art has been limited in minimizing laser beam damages due to minute variations in the laser light resistance of steel sheets, and this has led to practical problems in the production steps required for continuous processing of different steel sheets.

In light of this background, it has been a goal to develop a process which can produce grain-oriented electrical steel sheets with excellent magnetic properties without producing the laser irradiation damages that are a problem with pulse laser methods, and which can give improved characteristics for both iron loss and magnetostriction, as well as an apparatus for realizing such a process.

It is a first object of the present invention to provide a grain-oriented electrical steel sheet with low iron loss and very excellent magnetostriction properties.

It is a second object of the invention to provide a process for reducing iron loss of grain-oriented electrical steel sheets, which prevents surface laser irradiation damages by conventional pulse laser irradiation, which greatly minimizes increased magnetostriction which is a problem with continuous-wave lasers, and which involves laser processing steps suitable for high-speed, continuous processing.

It is a third object of the invention to provide an apparatus for producing grain-oriented electrical steel sheets with reduced iron loss of the grain-oriented electrical steel sheets by laser irradiation and with minimal surface laser irradiation damages, which is a laser irradiation apparatus easily suitable for variation in laser light resistance of a given steel sheet surface, while constantly and consistently minimizing laser irradiation damages.

DISCLOSURE OF THE INVENTION

The present invention relates to a grain-oriented electrical steel sheet with improved magnetic properties achieved by a reduced magnetic wall spacing with pulse laser light irradiation, which grain-oriented electrical steel sheet is characterized in that the rolling direction width of the periodic closure domain generated by laser irradiation is no greater than 150 $\mu$m, the depth in the direction of the steel sheet thickness is at least 30 $\mu$m, and the product of the lengths in the direction of width and the direction of depth is at least 4500 $\mu m^2$.

The present invention further relates to a grain-oriented electrical steel sheet with improved magnetic properties achieved by a reduced 180° magnetic wall spacing with pulse laser light irradiation, which grain-oriented electrical steel sheet is characterized in that the rolling direction width of the periodic closure domain generated by laser irradiation is no greater than 150 $\mu$m, the depth in the direction of the steel sheet thickness is at least 30 $\mu$m and the product of the lengths in the direction of width and the direction of depth is at least 4500 $\mu m^2$, wherein the magnetostriction with materials of 0.23 mm sheet thickness ($\lambda$19p-p compression) is no greater than $0.9\times10^{-6}$, and the magnetostriction with materials of 0.27 mm steel sheet thickness ($\lambda$19p-p compression) is no greater than $1.3\times10^{-6}$.

The magnetostriction ($\lambda$19p-p compression) is the stretch rate under 0.3 kg/mm$^2$ compression stress in a 1.9 T magnetic field.

The present invention further relates to a process for producing a grain-oriented electrical steel sheet with improved magnetic properties by laser beam irradiation at equal spacing on the surface of a grain-oriented electrical steel sheet, which is a laser irradiation process whereby the laser is a pulse oscillation Q-switched $CO_2$ laser, the irradiated beam shape is an oval with long axis in the direction of steel sheet width, the irradiation power density of the laser pulse is set to be no higher than the glass film damage threshold of the steel sheet surface to minimize laser irradiation damages, and the length of the long axis of the oval beam is set to at least the pulse beam irradiation spacing in the direction of steel sheet width to overlay a successive pulse beam on the steel sheet surface and thus provide sufficient cumulative irradiation energy necessary to improve the magnetic properties.

The present invention still further relates to an apparatus for producing a grain-oriented electrical steel sheet with improved magnetic properties by laser beam irradiation on the surface of a grain-oriented electrical steel sheet, which is an apparatus for producing a grain-oriented electrical steel sheet with excellent magnetic properties, having focusing members such as lenses or mirrors for focusing an irradiated laser beam independently provided in the steel sheet width direction and the rolling direction, having adjusting mechanisms which independently modify the distances from each focusing member to the irradiated surface of the steel sheet, and are designed to allow free adjustment of the diameter of the laser irradiation beam in the steel sheet width direction and the rolling direction. In the apparatus for producing a grain-oriented electrical steel sheet with excellent magnetic properties according to the invention, the focal length of the focusing device in the steel sheet width direction of the irradiated laser beam is adjusted to be longer than the focal length of the focusing device in the rolling direction.

BEST MODE FOR CARRYING OUT THE INVENTION

According to the invention, for improved magnetic properties achieved by a reduced magnetic wall spacing with pulse laser light irradiation of a grain-oriented electrical steel sheet, the conditions to be satisfied for achieving improvement to excellent magnetic properties are such that the rolling direction width in the periodic closure domain generated by laser irradiation is no greater than 150 $\mu$m, the depth in the direction of the steel sheet thickness is at least 30 $\mu$m, and the product of the lengths in the direction of width and the direction of depth is at least 4500 $\mu m^2$. The reasons for these conditions are explained below.

Iron loss from grain-oriented electrical steel sheets is categorized as either anomalous loss or hysteresis loss. Anomalous loss is lower for steel sheets with narrower 180° magnetic wall spacings. With laser magnetic domain control, a closure domain (=90° magnetic domain) is produced by periodic introduction of elastic deformation in the rolling direction by laser irradiation. As a result, the 180° magnetic wall spacing is narrowed, and the anomalous loss is reduced. The fragmentation effect in the magnetic domain created at the 180° magnetic wall (=main magnetic domain) increases in a manner dependent on the size of the closure domain generated, and from the standpoint of reducing only anomalous loss, a greater closure domain (=volume) is preferred.

On the other hand, hysteresis loss is in a positive correlation with the rolling direction width of the closure domain. Consequently, when a large deformation, or closure domain, is created to reduce anomalous loss, the closure domain is generally increased, thus raising the degree of hysteresis loss. The result is an overall increase in iron loss.

Figure 1:
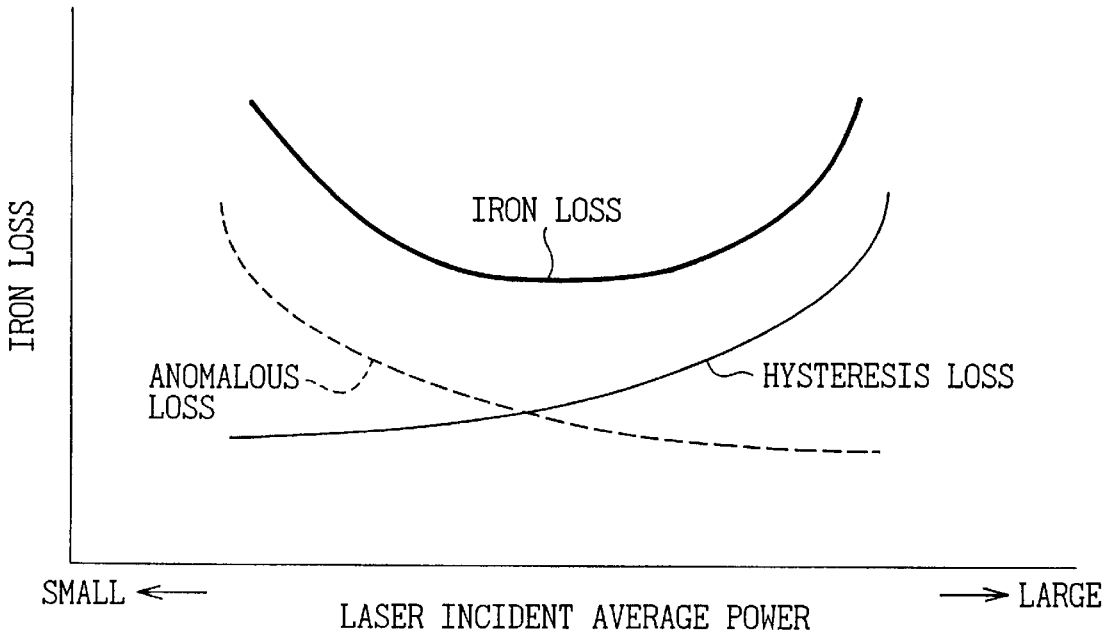
FIG. 1 is an illustration showing the relationship between incident laser power and iron loss.

In a macro sense, the volume of a closure domain is proportional to the average power of the incident laser. FIG. 1 is a graphical illustration of the relationship between incident laser average power and anomalous loss, hysteresis loss and their total iron loss.

Magnetostriction also has a positive correlation with the rolling direction width of the closure domain. Consequently, in order to reduce anomalous loss, hysteresis loss and magnetostriction simultaneously, the volume of the closure domain may be increased while reducing the width in the rolling direction. That is, the optimum form of the closure domain is to be narrow in the rolling direction, deep in the steel sheet thickness direction, and to have a prescribed volume or greater.

The present inventors have examined closure domain widths and depths, and their relationship with irradiated laser beam shapes, to determine a magnetic domain shape which would give high magnetic properties. First, the rolling direction width of a closure domain is proportional to the rolling direction diameter dl of the beam. From this standpoint, dl is preferred to be as small as possible. As shown in FIG. 8, it has been shown that magnetostriction decreases markedly when dl is under 0.28 mm. The closure domain width here was measured to be 150 $\mu$m (0.15 mm), and the depth at least 30 $\mu$m. Judging from the relationship between dl and iron loss improvement shown in FIG. 7, the iron loss improvement is greatest when dl is around 0.28 mm. This results from the decrease in hysteresis loss due to the smaller closure domain width. However, the iron loss improvement is instead lower when dl is 0.20 mm. This is because, despite a closure domain depth of 30 $\mu$m, the width is about 100 $\mu$m, resulting in a smaller closure domain volume.

These results led to the conclusion that the rolling direction width of a closure domain is optimum at 150 $\mu$m or less, in which case the depth must also be at least 30 $\mu$m. Consequently, the magnetic domain volume is proportional to the product of the rolling direction width and the steel sheet thickness direction width, which has an optimum value of at least 4500 $\mu m^2$.

The next important aspect of the laser closure domain controlling method of the invention is that the surface damage is minimized, while heat deformation is effectively introduced.

Figure 2A:
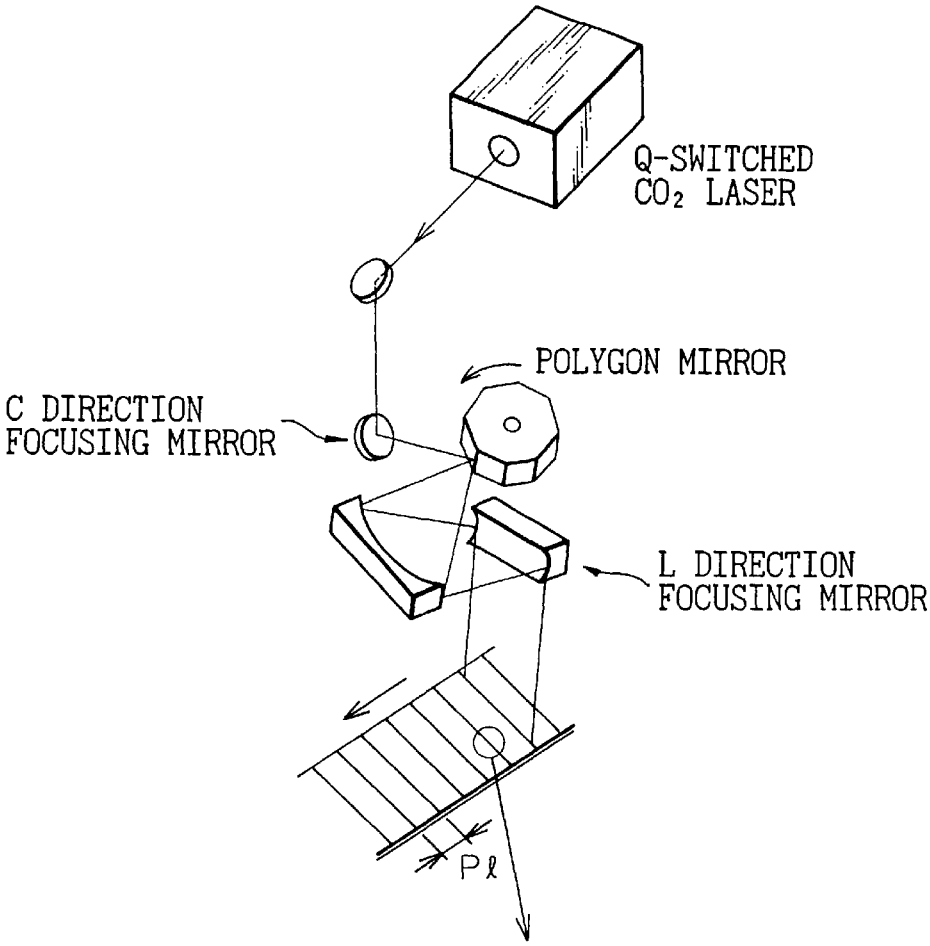
FIGS. 2(*a*) and 2(*b*) are illustrations of an embodiment of the laser irradiation method according to the invention, wherein FIG. 2(*a*) is a schematic view of the whole, and FIG. 2(*b*) is an enlarged view of the area of irradiation.
Figure 2B:
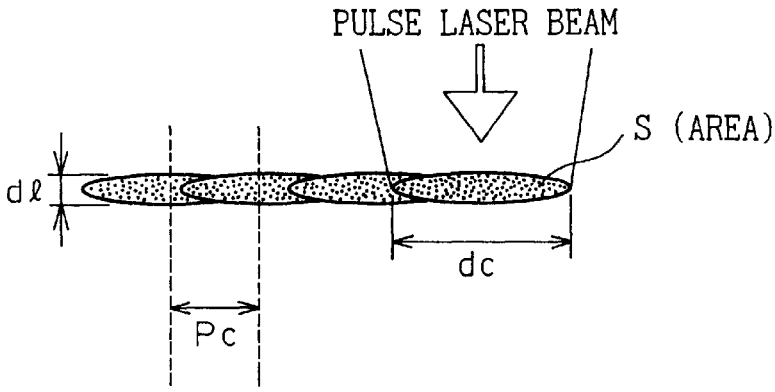

FIG. 2(*a*) is an illustration of one embodiment of the laser magnetic domain control method of the invention, and FIG. 2(*b*) is an enlarged view of the irradiation area. The steel sheet is a grain-oriented electrical steel sheet with the rolling direction (direction 1) aligned with the easy magnetization direction (180° magnetic domain). The irradiated Q-switched $CO_2$ laser pulse beam is focused into an oval with short axis dl in the rolling direction and long axis dc in the steel sheet thickness direction, by independent focusing mirrors, or lenses, in the two orthogonal directions L and C. The scanning direction and the oval beam long axis direction are aligned, and the focused beam is irradiated by scanning at a prescribed spacing Pc with a polygon mirror or the like. It is also irradiated at a prescribed spacing P1 in the rolling direction. Here, dc is set to be larger than Pc, for continuous overlaid pulse laser light on the steel sheet.

The relational expressions for the irradiation parameters of the laser by this method are given below as equations (1) and (2). Here, Pp is the pulse peak power, Ip is the peak power density, Ep is the pulse energy and Up is the cumulative energy density at a given point on the scan line. S is the beam area, and Vc and Fp are the C-direction scanning speed and the repeating frequency of the pulse, respectively. n is the number of pulse overlays.

$$Ip=(Pp/S) \quad \text{Equation (1)}$$

$$Up=(Ep/S)\cdot n=(4Ep)/(\pi\cdot de\cdot Pc) \quad \text{Equation (2)}$$

$$(n=dc/Pc,\ S=(\pi/4)(de\cdot dc))$$

The irradiation parameters when using a continuous-wave laser are represented by the following equations (3) and (4). Here, Pav is the average output of the continuous-wave laser, and $\tau$ is the beam irradiation time at a given point on the scan line.

$$Ip=(Pav/S) \quad \text{Equation (3)}$$

$$Up=Ip\cdot\tau=(4\cdot Pav)/(\pi\cdot de\cdot Vc) \quad \text{Equation (4)}$$

$$(\tau=dc/Vc)$$

Figure 3A:
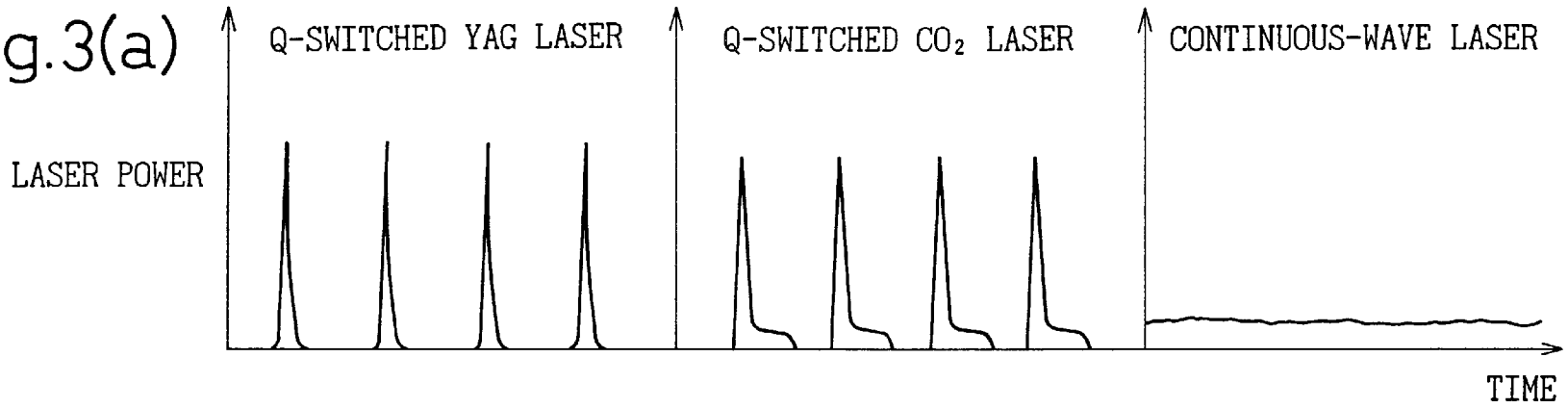
FIG. 3(*a*) is an illustration showing the output waveform of different lasers, and FIG. 3(*b*) is an illustration showing the temperature history of selected points on a scanning line when using the laser irradiation method of the invention for different lasers.
Figure 3B:
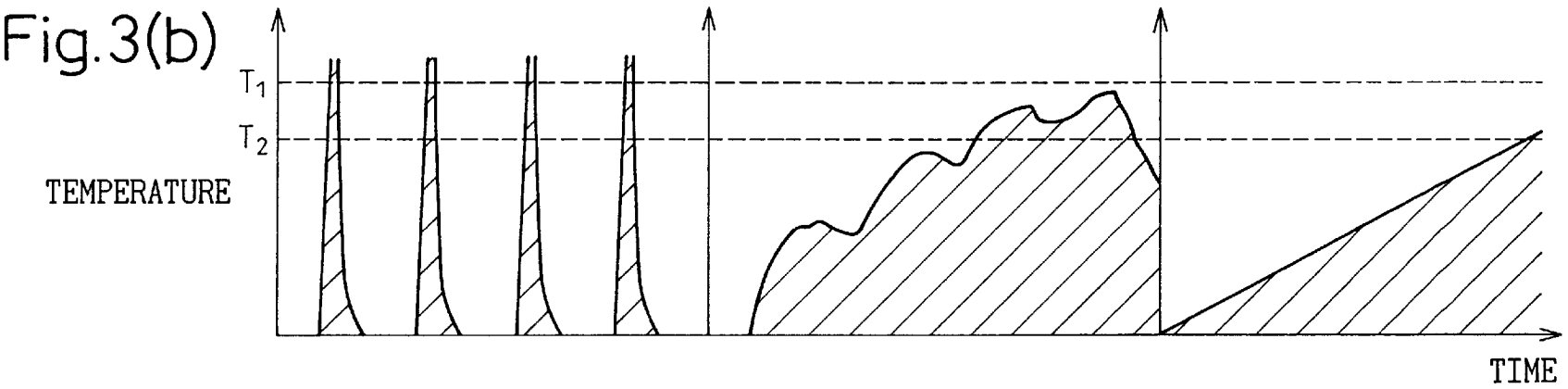

FIG. 3 will now be referred to for summarization of the principle of irradiation damages and introduction of heat deformation with a pulse laser and a continuous-wave laser, to explain the effect of laser magnetic domain control according to the invention.

FIG. 3(*a*) shows the laser waveform for a Q-switched YAG laser, a Q-switched $CO_2$ laser and a continuous-wave laser. As also indicated in Japanese Examined Patent Publication No. 5-32881, Q-switched YAG lasers are characterized by very short pulse times of about 0.01 $\mu$s, and the peak power is very high despite the low pulse energy. In comparison, $CO_2$ lasers which are of a similar type as Q-switched lasers have long pulse time widths of 0.2–0.5 $\mu$s, and their peak power is relatively low. They are characterized by having a low peak/high energy tail portion following the initial pulse, and the heat input can be adjusted by the tail time length.

FIG. 3(*b*) is a graphical representation of the temperature history for a given point on a steel sheet surface with the different laser irradiations explained for FIG. 3(*a*). Generation of surface damages by laser irradiation is characterized by the threshold temperature $T_1$. Also, the heat deformation which produces the closure domain is characterized by the threshold temperature $T_2$. $T_1$ corresponds to the softening/melting temperature of the surface insulation film, or about 800° C. On the other hand, $T_2$ is about 500° C., as estimated from the heat deformation release temperature. Thus, in order to minimize irradiation damages and introduce heat deformation, the steel sheet temperature may be controlled to between 500 ° C. and 800° C.

The temperature history and the deformation introducing effect will now be explained. The heating rate corresponding to the inclined temperature increase in FIG. 3(*b*) is proportional to the energy density of the irradiating laser per unit time, or the power density Ip. Since heat deformation is introduced by rapid heating/rapid cooling of the steel sheet, the introduction of deformation is highly efficient when using a high peak power laser. Consequently, compared to a continuous-wave laser, a pulse Q-switched layer has lower irradiation energy to allow greater improvement in magnetism. However, the total deformation volume and the deformation penetration depth in the steel sheet thickness direction is proportional to the total irradiated energy density Up, and in FIG. 3(*b*) it is proportional to the time quadrature of the temperature history (shaded area in the drawing).

Thus, ideal laser magnetic domain control according to the invention involves a steel sheet temperature in the range of 500–800° C., repeated rapid heating/rapid cooling by pulse laser irradiation, and as efficient introduction as possible of the total energy Up introduced at a given point.

A detailed explanation will now be provided regarding the magnetic property-improving method of the present invention using a Q-switched $CO_2$ laser based on these findings. The Q-switched $CO_2$ laser used for the invention is a pulse laser apparatus with a lower peak output than a Q-switched YAG laser, but a higher one than a continuous-wave laser. The peak output is generally in the range of 10–1000 kW. The pulse time width, with an initial pulse time width of 200–500 ns, has a total length of 1–10 $\mu$s including the tail.

As explained for FIG. 2, the pulse laser beam irradiation method is scanning irradiation, with the L and C directions focused independently. In particular, the C direction which is the scanning direction is aligned with the long axis of the focused beam, and its scan spacing Pc is set to be no greater than the long axis length dc of the oval, so that the pulse laser beams are overlayed on the steel sheet surface. The pulse peak power density Ip is adjusted by varying the peak power and the beam focusing area, so that the steel sheet surface temperature does not reach the film damage threshold $T_1$ even with the overlaid beams. Under beam irradiation conditions with Ip controlled in this manner, the irradiation energy density per single pulse also decreases at the same time, such that effective introduction of deformation is generally not possible. However, according to the invention a number of pulses are irradiated on any given point of the steel sheet due to beam overlay. The number of pulses n irradiated at each point is obtained by equation (2) above from the beam long axis dc and the scan spacing Pc. Consequently, as shown in FIG. 3(*b*), since intermittent rapid heating/rapid cooling is repeated by n pulses at a pulse repetition frequency Fp, it is possible in terms of energy to increase Up by the cumulative effect of pulse overlay to adequately provide the required deformation for magnetic domain fragmentation, while maintaining a high introduction of deformation as the advantage of a pulse laser.

Through the mechanism described above, the present invention has the advantage of minimizing laser irradiation damages and providing an efficient magnetic domain control effect.

The present invention employing a Q-switched $CO_2$ laser will now be compared with a case employing a Q-switched YAG laser. As shown in FIG. 3(*b*), the Q-switched YAG laser has a low pulse time width and a high peak power. For example, when Q-switched oscillation is accomplished in a flash lamp-excited YAG laser medium using electrooptical crystals, the pulse time width is usually 0.01 $\mu$s or less and the pulse peak power at least 1 MW. Precise heating/temperature control is difficult with such short time-width, high peak pulse laser light, and film damage easily occurs. It is possible here to increase the beam diameter in the same manner as the irradiation method of the invention, to reduce the Ip per single pulse. However, since the energy density per single pulse is also considerably lower at the same time, while the pulse time width is short, a pulse energy cumulative effect can only be achieved by operation at a very high pulse repetition frequency of 1 MHz or greater, which is impossible in practical terms. Consequently, it is difficult to improve the characteristics of grain-oriented electrical steel sheets to avoid producing irradiation damages with Q-switched YAG lasers.

Q-switched $CO_2$ lasers also have a major advantage from the standpoint of industrial application. For increased laser treatment speeds in grain-oriented electrical sheet production processes, Q-switched lasers with a large average output, which is the product of the pulse energy and the pulse repetition frequency, are preferred. The average output of a Q-switched laser is proportional to the average output of the continuous-wave laser on which it is based. In the case of solid crystal YAG lasers, an average output of about 5 kW is the limit, while it is relatively easy to produce large gas medium $CO_2$ lasers, and continuous-wave laser apparatuses with outputs of over 40 kW are commercially available. Also, $CO_2$ lasers have low equipment and operating costs. Thus, using a Q-switched $CO_2$ laser affords the advantages of low cost and applicability to magnetism-improvement techniques in high-speed, large-sized grain-oriented electrical steel sheet production processes.

Figure 13:
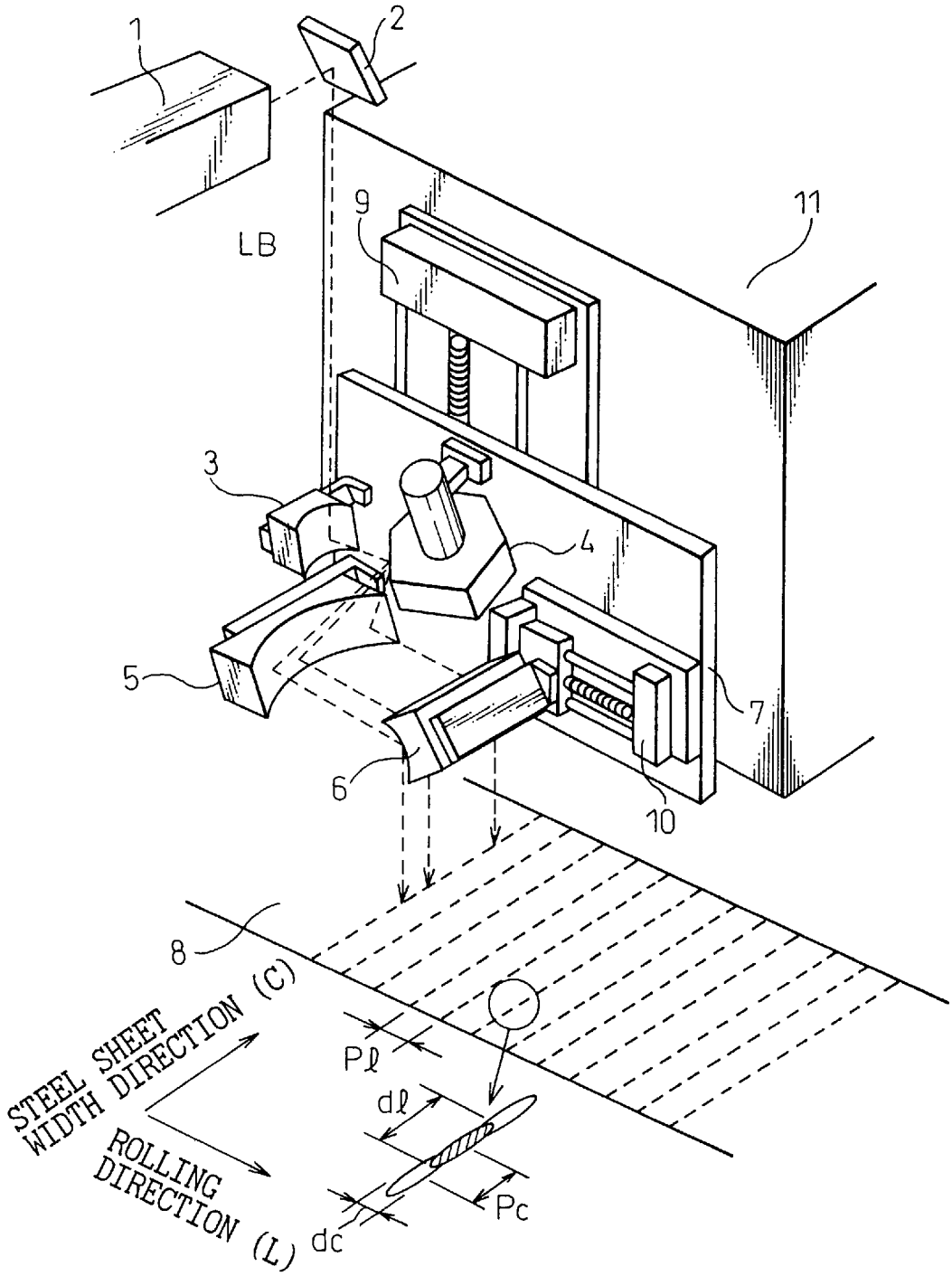
FIG. 13 is a general illustration of a laser irradiation apparatus according to the invention.
Figure 14A:
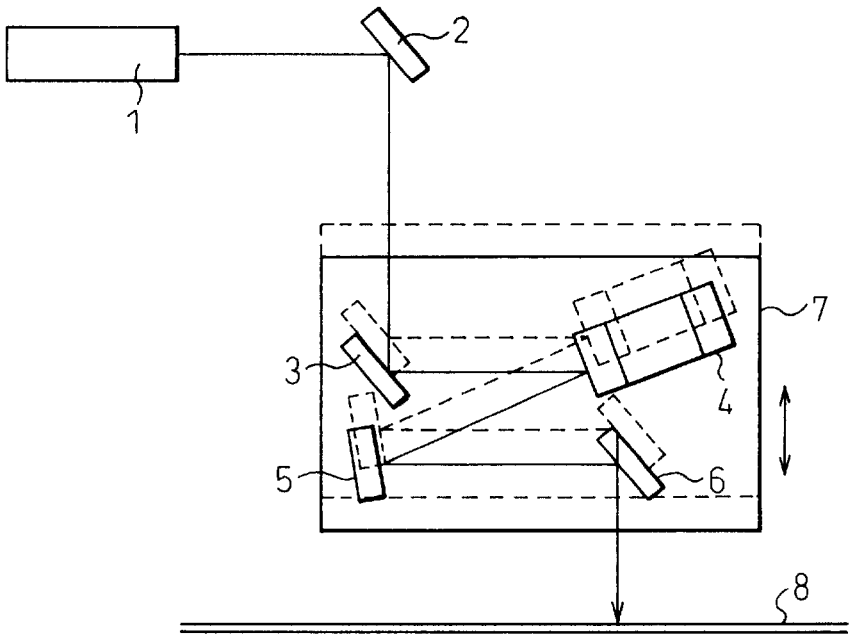
FIG. 14(*a*) is an illustrative view of a laser irradiation apparatus according to the invention as seen from the steel sheet width direction, which shows the positioning mechanism for the platform 7, and FIG. 14(*b*) is an illustrative view of a laser irradiation apparatus according to the invention as seen from the steel sheet width direction, which shows the positioning mechanism for the focusing mirror 6.
Figure 14B:
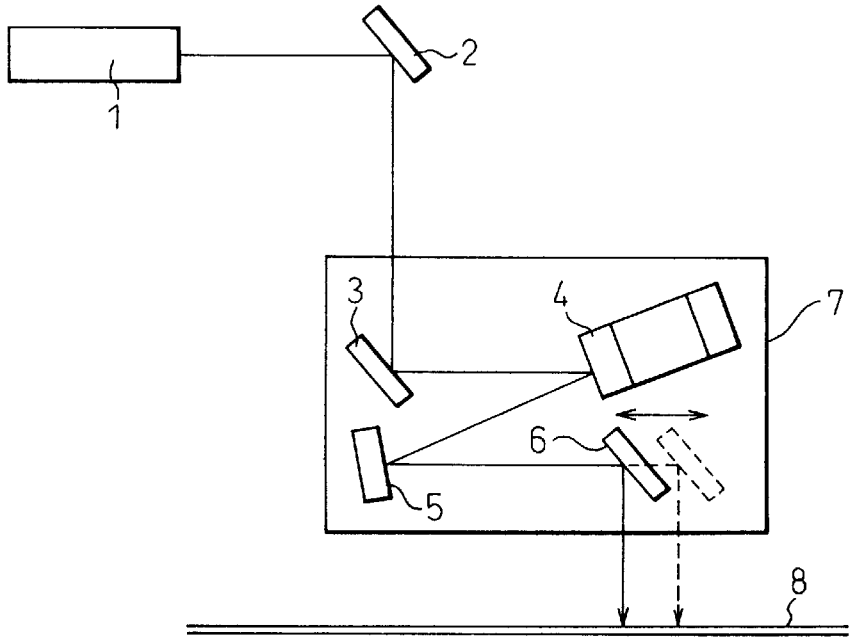

FIG. 13 and FIG. 14 are illustrations of an apparatus of the invention. According to the process for producing a grain-oriented electrical steel sheet of the invention, a laser beam is focused onto the surface of a steel sheet 8 as an oval with long axis dl in the sheet width direction and short axis dc in the rolling direction, as shown in FIG. 13. The focused laser beam is scanned at a fixed speed in the direction of the steel sheet width. When a continuous-wave laser beam is used, the laser irradiation time T at a given point is represented by equation (5). When a pulse laser beam is used, the irradiation is intermittent and the irradiation pitch Pl in the scanning direction is represented by equation (6), where Fp [Hz] is the pulse repetition frequency. The irradiation is emitted at a fixed spacing Pl in the rolling direction, by a laser beam intermittent interrupting device (not shown).

$$T=dl/V \qquad \text{Equation (5)}$$

$$Pl=V/Fp \qquad \text{Equation (6)}$$

Figure 15:
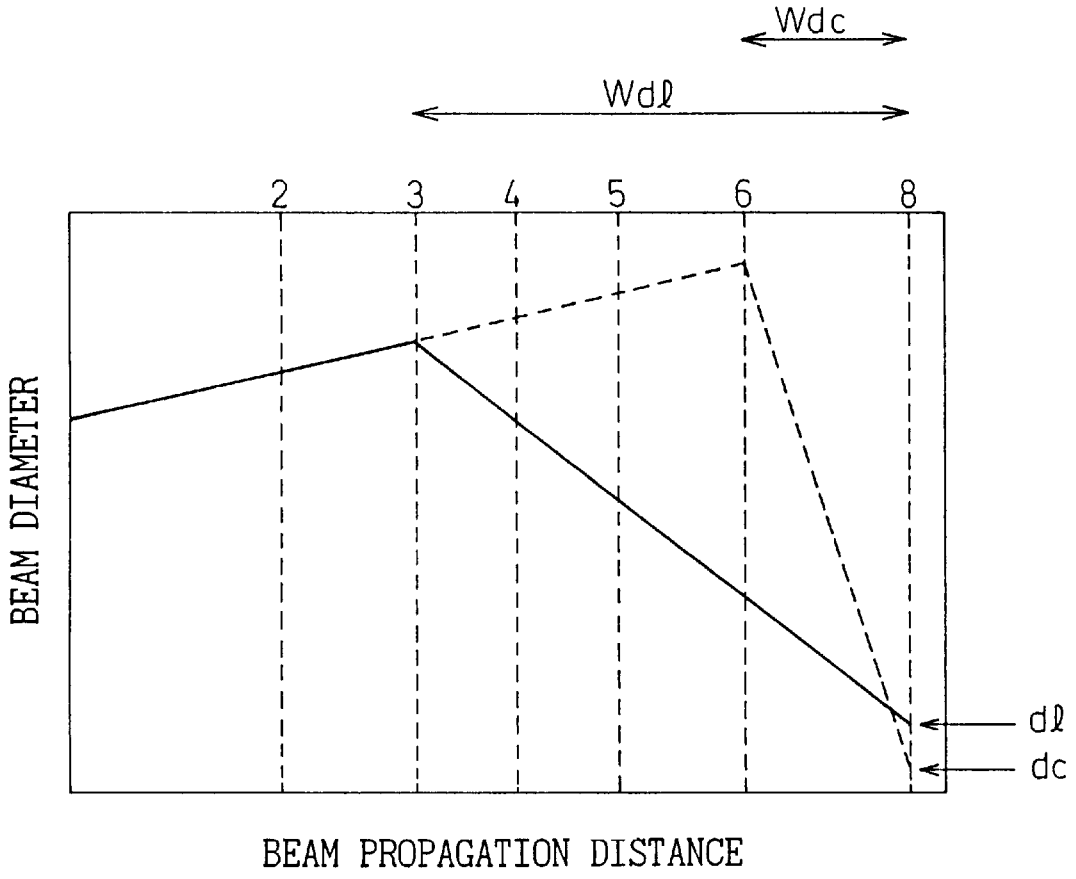
FIG. 15 is a graph showing the relationship between the laser beam propagation length and the beam diameter.

FIGS. 14(*a*) and (*b*) are schematic views of an apparatus of the invention as seen from a cross-section in the direction of steel sheet width. The laser beam LB emitted from the laser apparatus 1 is introduced to a platform 7 through a mirror 2. On the platform 7 there are provided a cylindrical focusing mirror 3 with a focal length of fl for focusing in the steel sheet width direction, a polygon mirror 4, a scanning mirror 5 and a cylindrical focusing mirror 6 with a focal length of f2 for focusing in the rolling direction. The laser beam LB incident to the platform 7 is focused at the focal length f1 with the mirror 3 only in the sheet width direction. The laser beam LB is then converted to a scanning beam parallel to the steel sheet width direction, by combination of the polygon mirror 4 and the mirror 5. The beam is also focused at the focal length f2 with the mirror 6 only in the rolling direction, and irradiated onto the steel sheet 8. FIG. 15 is a graphical illustration of the relationship between the laser beam propagation length and the beam diameter. The laser beam is focused on the steel sheet surface to the beam diameters dl and dc which are determined by f1, f2 and Wdl, Wdc.

As shown in FIG. 13, the platform 7 is provided with a mechanism which moves vertically with respect to steel sheet 8 and is situated on a fixed base 11 via a positioning device 9. The focusing mirror 6 is provided with a mechanism which moves parallel to the rolling direction and is situated on the platform 7 via a positioning device 10. Thus, as shown in FIG. 14, the vertical movement of the platform 7 simultaneously changes the distance Wdl between the steel sheet width direction-focusing mirror 3 and the steel sheet 8, and the distance Wdc between the rolling direction-focusing mirror 6 and the steel sheet 8. Meanwhile, the parallel movement of the mirror 6 in the rolling direction independently changes only Wdl. Thus, the combination of the two movements allows free modification and adjustment of Wdl and Wdc. As a result, precise adjustment can be easily made to the steel sheet width direction diameter dl and the rolling direction diameter dc on the steel sheet surface, without altering the focal lengths f1 and f2, i.e. the curvature radii, of the focusing mirrors.

As shown in FIGS. 13 and 14, this irradiation apparatus is characterized in that the laser beam diameters are each independently controlled by the focusing mirrors 3, 6 in the sheet width direction (C) and the rolling direction (L), and the C direction focusing system has a longer focus than the L direction focusing system.

Since, according to the technique of the present invention, it is important for the L direction beam diameter dl to be precisely focused to about 0.2–0.3 mm, the mirror 6 must be a focusing mirror with a relatively short focus. As a result, the focus depth is smaller, and therefore since a precise adjusting mechanism is required for the distance Wdc between the mirror 6 and the steel sheet 8, the positioning mechanism 9 is essential. However, when a steel sheet width direction-focusing mirror 3 is provided independently as in the construction of the invention, and the focus of the mirror is made longer than that of the rolling direction-focusing mirror 6, its focus depth is larger than that of the mirror 6. As a result, variations in the steel sheet thickness direction diameter dc within the range of adjustment of Wdc by the positioning mechanism 9 can be ignored for the most part.

Consequently, although it is most preferred to provide positioning mechanisms 9, 10 as shown in FIG. 13 for independent control of Wdl and Wdc, the positioning mechanism 10 may be omitted from the features of the mirror construction described above.

Figure 11A:
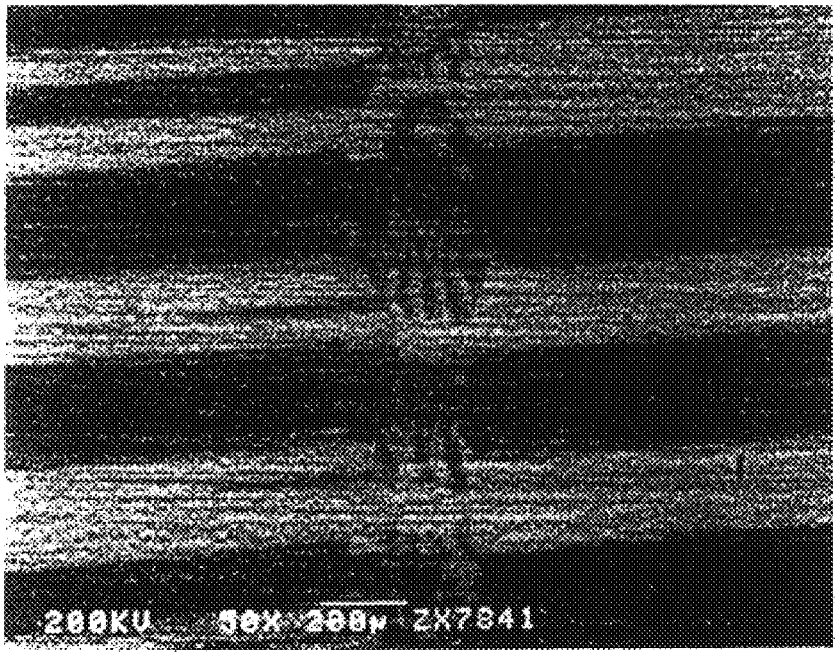
FIGS. 11(*a*) and 11(*b*) are pictures showing the periodic closure domain width for the prior art method FIG. 11(*a*) and the present invention FIG. 11(*b*).
Figure 11B:
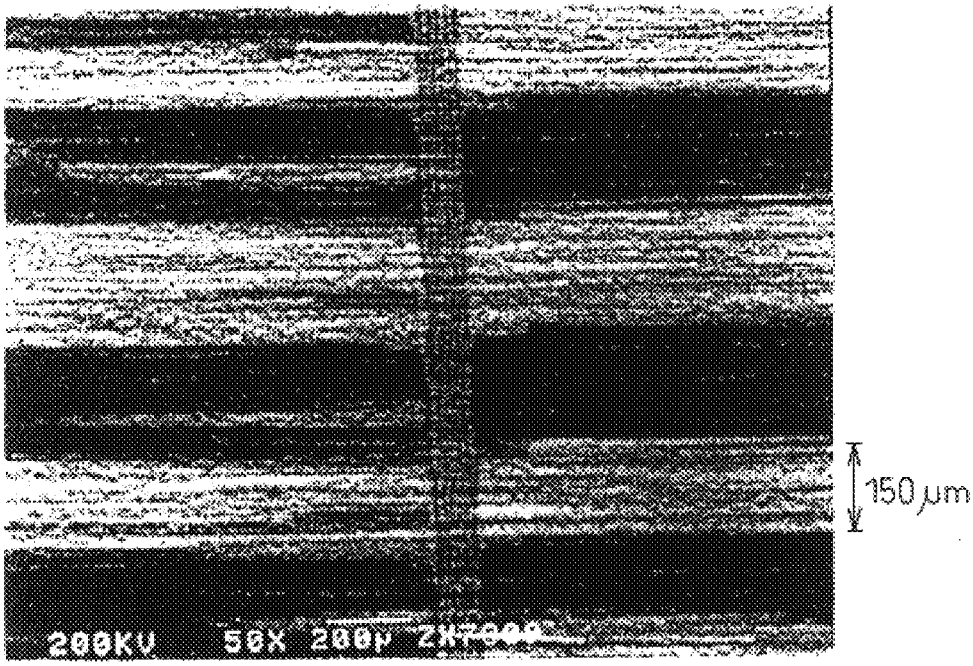

Upon detailed observation of periodic closure domains of grain-oriented electrical steel sheets with pulse laser magnetic domains controlled according to the invention, it was found that deeper closure domains are present than with steel sheets of the conventional method (for control of magnetic domains created by surface irradiation damages of pulse lasers) as shown in Table 1, and as shown in FIG. 11(*b*), the width of these closure domains are reduced to 150 μm or less, while the rolling direction width is narrower compared to the conventional method shown in FIG. 11(*a*). Consequently, as clearly shown by Table 1 and FIG. 11, grain-oriented electrical steel sheets obtained according to the invention had narrower and deeper closure domain shapes than those obtained according to the prior art.

TABLE 1

| Etching depth | 0 (μm) | 20 | 25 | 32 | 44 | 52 | 60 |
|---|---|---|---|---|---|---|---|
| Present invention | ○ | ○ | ○ | ○ | ○ | Δ | x |
| Prior art method | ○ | ○ | ○ | x | x | x | x |

○: closure domains present
Δ: closure domains partially present
x: no closure domains The magnetostriction value for the material of the grain-oriented electrical steel sheet is directly proportional to the noise of the transformer product, and usually when the magnetostriction is $1.3\times10^{-6}$ or less, the transformer noise is reduced to a level which is not unpleasant to humans. If the magnetostriction is even lower at $0.9\times10^{-6}$ or less, the transformer noise is markedly reduced to eliminate even any slight unpleasantness. The grain-oriented electrical steel sheet of the present invention has very minimal magnetostriction (with a thickness of 0.23 mm material) due to the feature of the closure domain shape, and the magnetostriction value is $0.9\times10^{-6}$ or less, as shown in the following table. Consequently, by using a grain-oriented electrical steel sheet of the invention it is possible to produce transformers with very low noise compared to the prior art.

The values for magnetostriction (λ19p-p compression) according to the continuous-wave laser method, conventional pulse laser method and the present invention are shown in Tables 2 and 3, for steel sheet thicknesses of 0.23 mm and 0.27 mm, respectively.

TABLE 2

| Sheet thickness: 0.23 mm | Continuous-wave laser method | Conventional pulse laser method | Present invention |
|---|---|---|---|
| Beam shape (dl × dc) | 0.28 × 9.5 mm | 0.43 × 0.43 mm | 0.28 × 9.5 mm |
| Magnetostriction (λ19p-p compression) | $1.2 \times 10^{-6}$ | $1.5 \times 10^{-6}$ | $0.9 \times 10^{-6}$ |

TABLE 3

| Sheet thickness: 0.27 mm | Continuous-wave laser method | Conventional pulse laser method | Present invention |
|---|---|---|---|
| Beam shape (dl × dc) | 0.28 × 9.5 mm | 0.43 × 0.43 mm | 0.28 × 9.5 mm |
| Magnetostriction (λ19p-p compression) | $1.6 \times 10^{-6}$ | $2.0 \times 10^{-6}$ | $1.3 \times 10^{-6}$ |

As clearly shown in Tables 2 and 3, the level of magnetostriction in the grain-oriented electrical steel sheets obtained according to the invention showed a superior magnetostriction property compared to the grain-oriented electrical steel sheets produced by the conventional continuous-wave laser method or pulse laser method.

Example

The surface of a 0.23 mm-thick high magnetic flux density grain-oriented electrical steel sheet was irradiated with a Q-switched $CO_2$ laser by the method of the invention, and the effect of improvement in irradiation damages and magnetic properties was evaluated. The L direction beam diameter dl was fixed at about 0.30 mm, and the C direction beam diameter dc was varied from 0.50–12.00 mm, to adjust Ip. The peak output Pp of the Q-switched oscillation was 20 kW, the pulse energy Ep was 8.3 mJ, the pulse repetition frequency Fp was 90 kHz and the average output was about 750 W. The scanning speed Vc was 43 m/s, the C direction irradiation pitch Pc during Q-switched laser irradiation was about 0.50 mm and the L direction pitch Pl was 6.5 mm. Also, using a continuous-wave laser, the average output Pav was 850 W, while the other conditions were the same as for the Q-switched laser.

Figure 4:
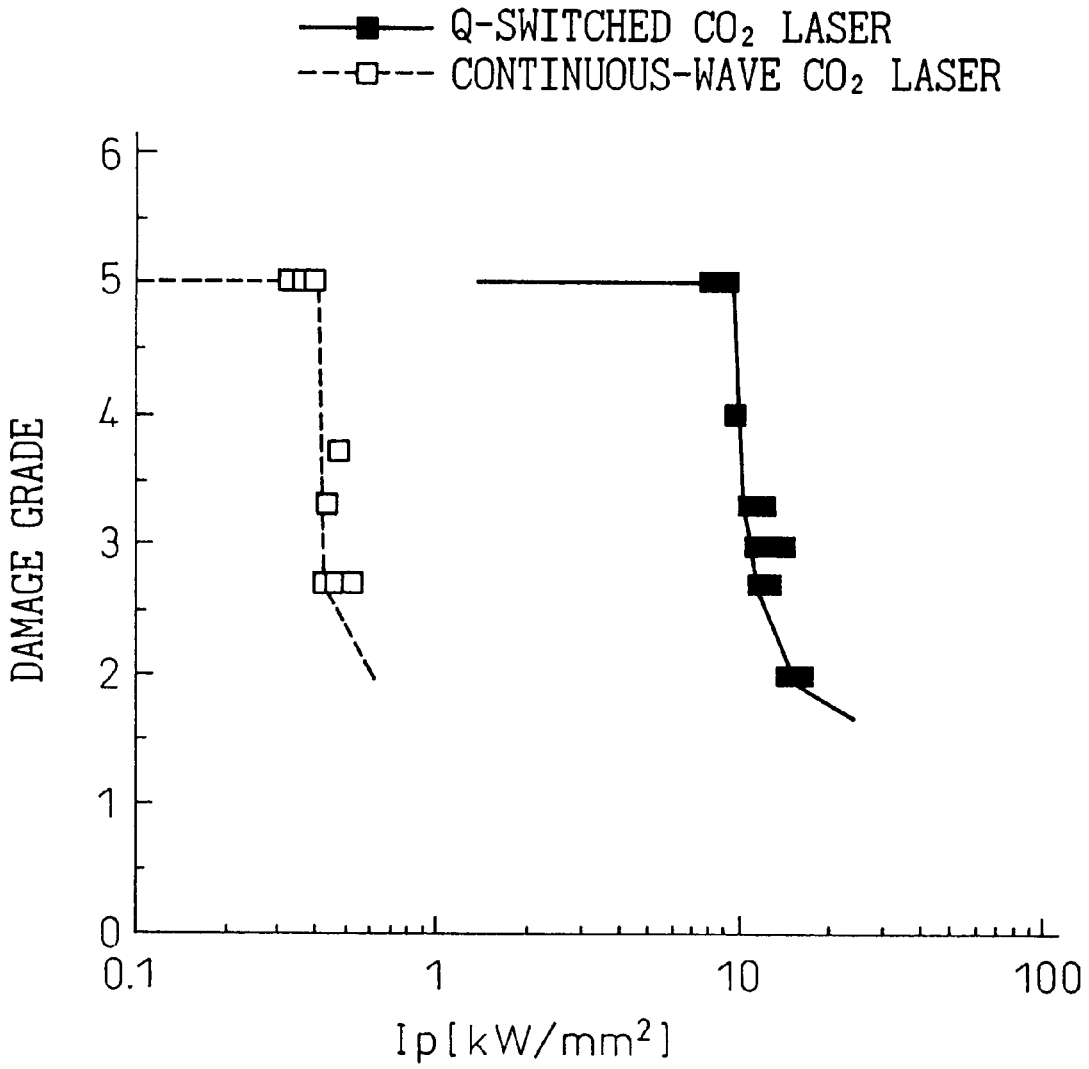
FIG. 4 is a relational graph for surface film damage grade and laser peak power density.

FIG. 4 shows the relationship between Ip and the surface grade of laser irradiation damages. The grade of laser irradiation damages was evaluated on a 5-level scale based on visual examination and an antirusting test. Specifically, grade 1 of the evaluation represents clear white damages, grade 2 represents white damages with finer flaws in the dl direction than grade 1, grade 3 represents minute white damages, grade 4 represents damages verifiable only by microscopic observation, and grade 5 represents no observable damages even with microscopic observation. Grades 3 and below include generated rust, and grades 4 and above have no generated rust. FIG. 4 shows that the irradiation damage-producing threshold power density with the Q-switched laser was over one figure higher than that with the continuous-wave laser. This is because, as shown in FIG. 3(*b*), despite the high peak power with a Q-switched laser, the irradiation is intermittent and therefore the steel sheet temperature does not reach the damage threshold $T_1$ even with the high peak power. In comparison, a continuous-wave laser, while having low instantaneous power, results in continuous accumulation of heat, so that fusion damage occurs in the film even at low power. It can be seen from FIG. 4 that in the case of the Q-switched $CO_2$ laser the film damage threshold power density is 12 kW/mm$^2$, and therefore it is possible to improve the magnetic properties with a pulse laser which does not produce irradiation damages with the Ip adjusted to below this value.

Figure 5:
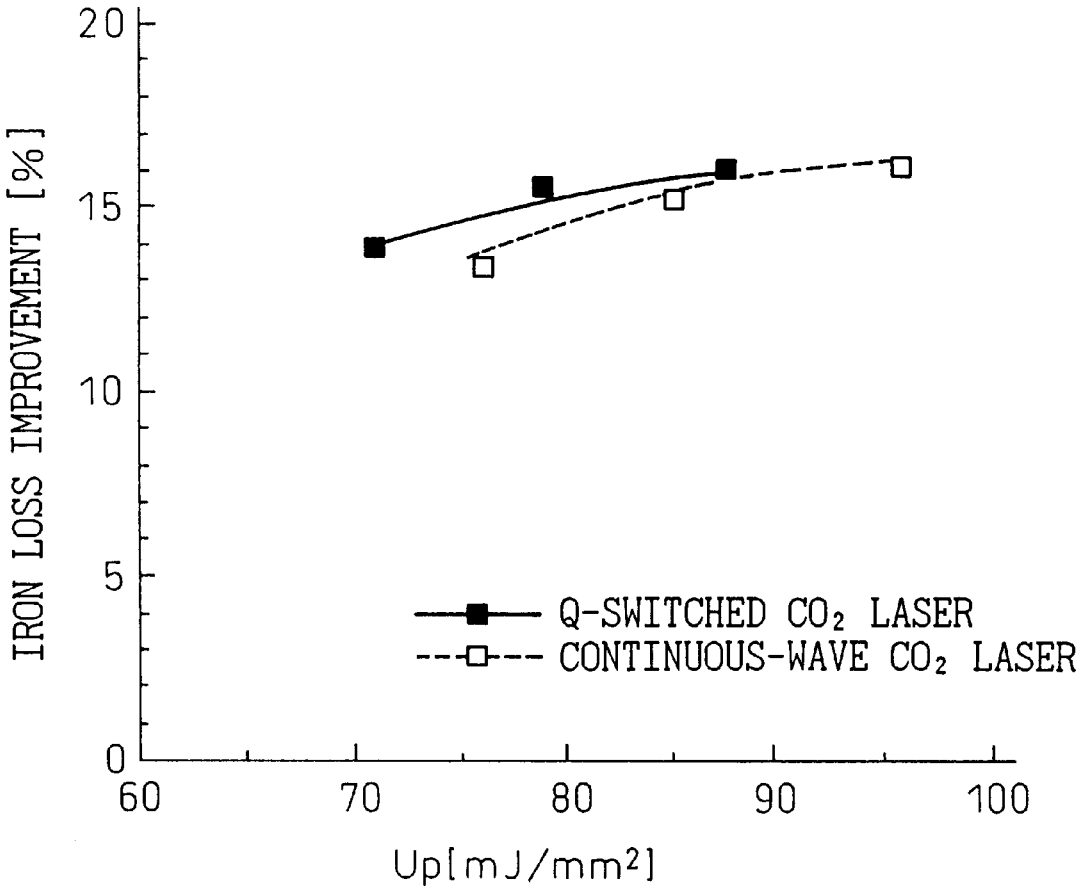
FIG. 5 is a relational graph for iron loss improvement and irradiation energy density.

FIG. 5 shows the results of comparing the continuous-wave $CO_2$ laser method and the Q-switched $CO_2$ laser method with the parameters of iron loss improvement and Up, with particular selection of a C direction beam diameter which did not produce laser irradiation damages under the irradiation conditions explained for FIG. 4. Here, the C direction beam diameter was 8.7 mm for the Q-switched laser and about 10.5 mm for the continuous-wave laser. It was thus demonstrated that the present invention employing a Q-switched $CO_2$ laser can provide iron loss improvement equivalent to the conventional continuous-wave laser method, at a lower irradiation energy dose.

Figure 6:
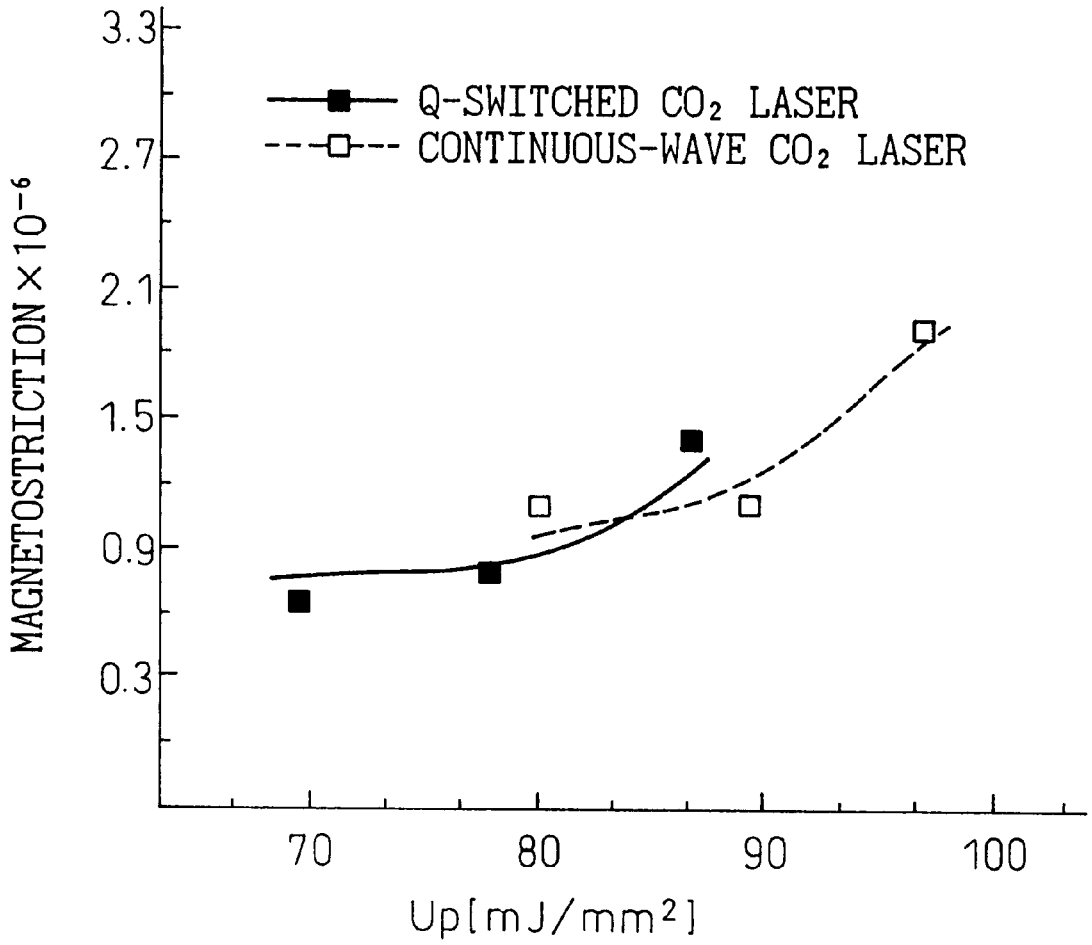
FIG. 6 is a relational graph for magnetic deformation and irradiation energy density.

Incidentally, magnetostriction which is as important a magnetic property of grain-oriented electrical steel sheets as iron loss, is a factor which is proportional to the noise resulting when the steel sheet is used as a transformer, and it is preferably as low as possible. FIG. 6 shows the results of comparing a Q-switched $CO_2$ laser with a continuous-wave $CO_2$ laser in terms of the relationship between magnetostriction and total irradiated energy Up. As shown in this graph, the magnetostriction increases with a larger Up. As explained with FIG. 5, treatment with a Q-switched $CO_2$ laser can give high improvement in iron loss with lower irradiation energy, and this results in an effect of reduced magnetostriction compared to continuous-wave laser-treated materials.

Figure 12A:
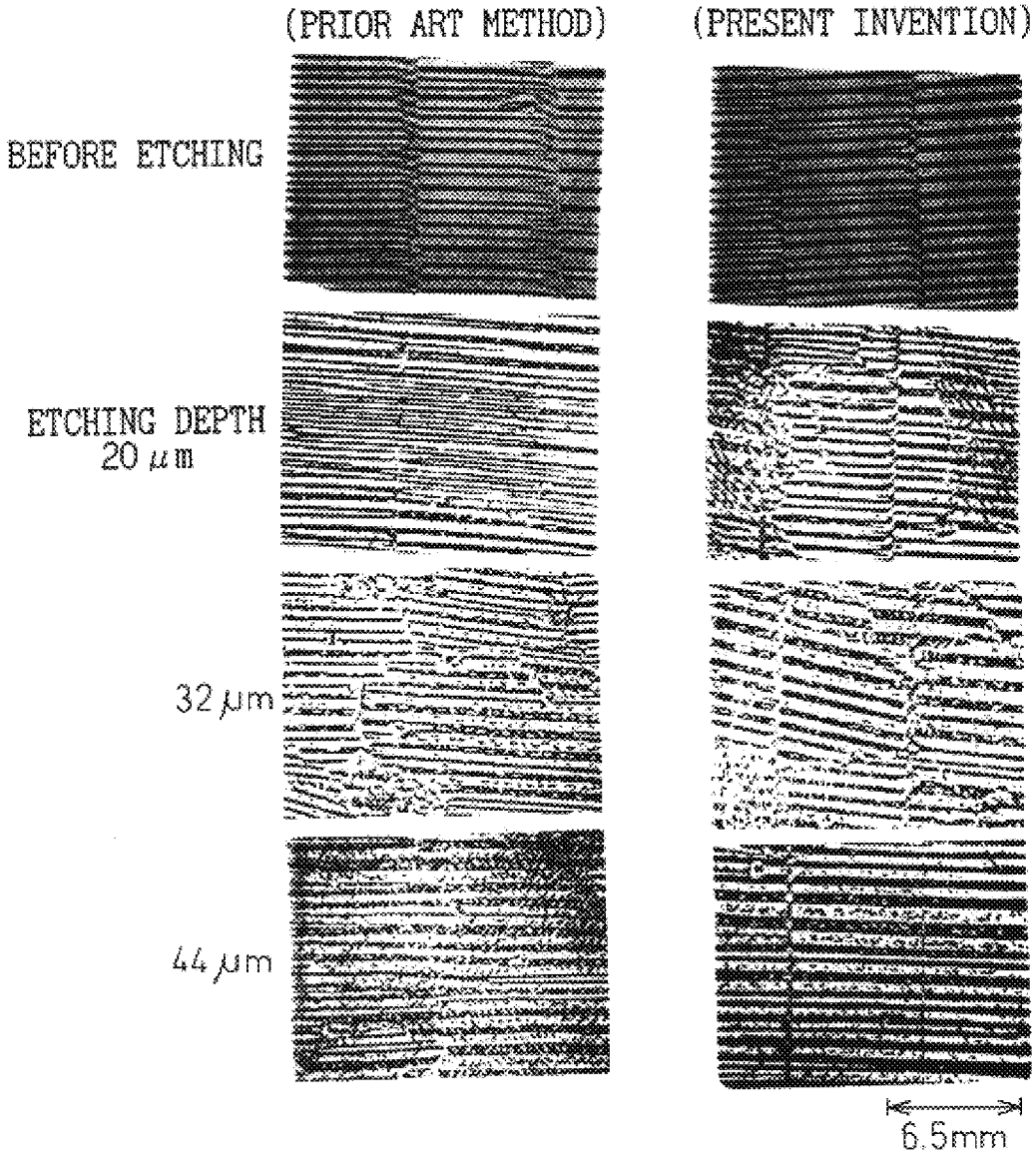
FIGS. 12(*a*) and 12(*b*) are a series of micrographs showing the magnetic domain pattern for elastic deformation in the direction of steel sheet thickness depth for the prior art and the present invention, with FIG. 12*a* showing observation at 6.5 mm and FIG. 12*b* showing observation at 10 mm.
Figure 12B:
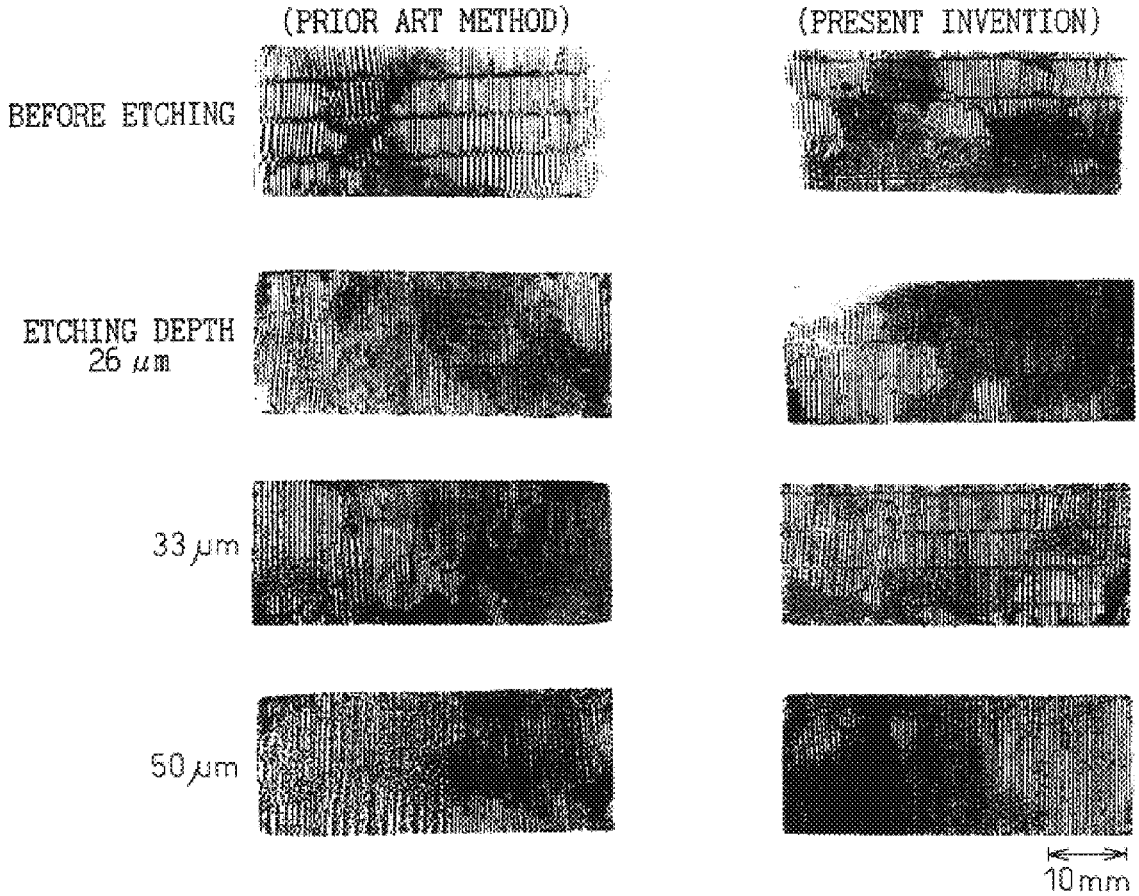

In addition, the magnetic domain pattern of the steel sheet also differs from the conventional method, and the closure domain width is narrow as shown in FIG. 11(*b*), while the elastic deformation in the direction of depth is greater than 30 μm, as seen by the change in magnetic domain pattern in FIG. 12, demonstrating that closure domains are present in the products of the invention even at deep sections of 30 μm and greater.

This example is related to the basic effect of the oval beam overlay irradiation method with a Q-switched $CO_2$ laser, which is the basic gist of the present invention. However, an even higher magnetic property improving effect can be achieved according to the invention by limiting the type of steel sheet, the oval beam shape, the irradiation pitch, the irradiation power/energy density and the pulse repetition frequency. The following is an example of improving the properties by limiting the irradiation conditions.

Figure 7:
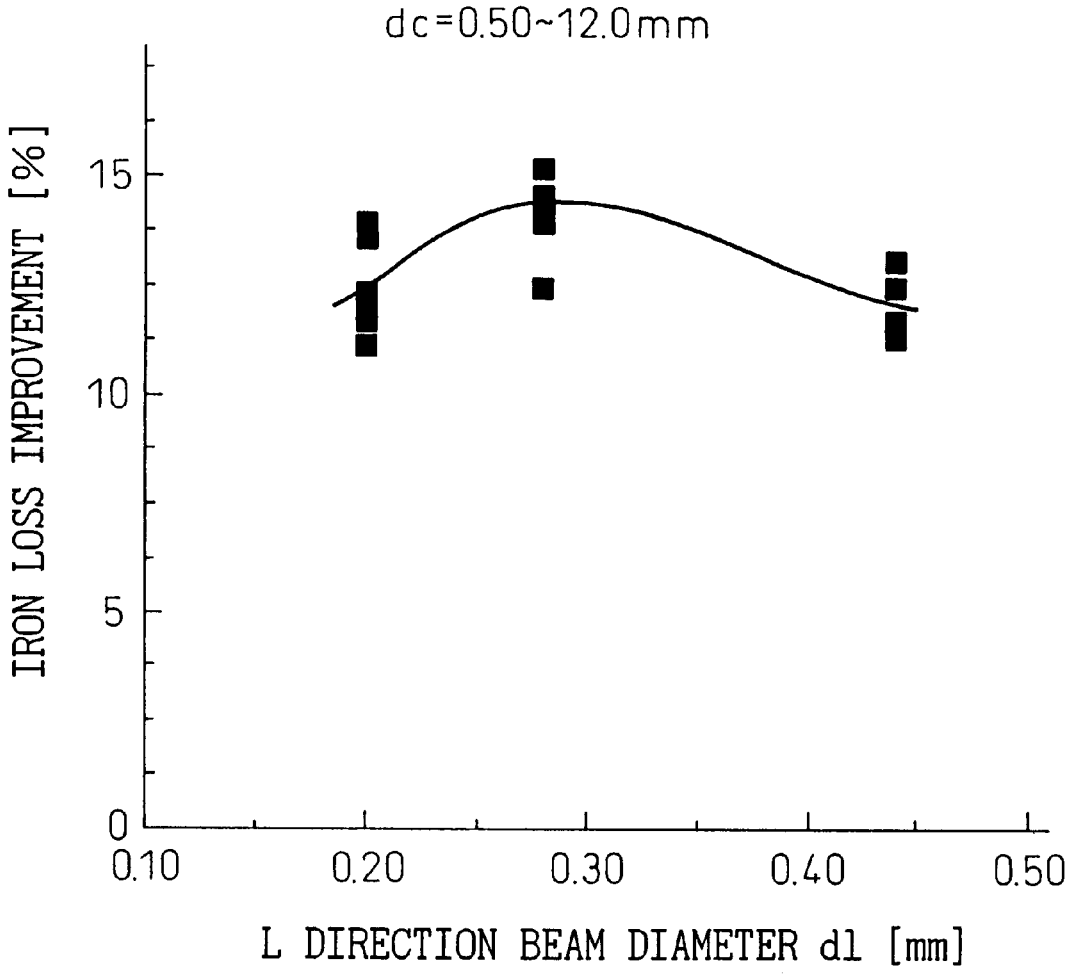
FIG. 7 is a relational graph for iron loss improvement and beam diameter in the L direction of an oval beam.
Figure 8:
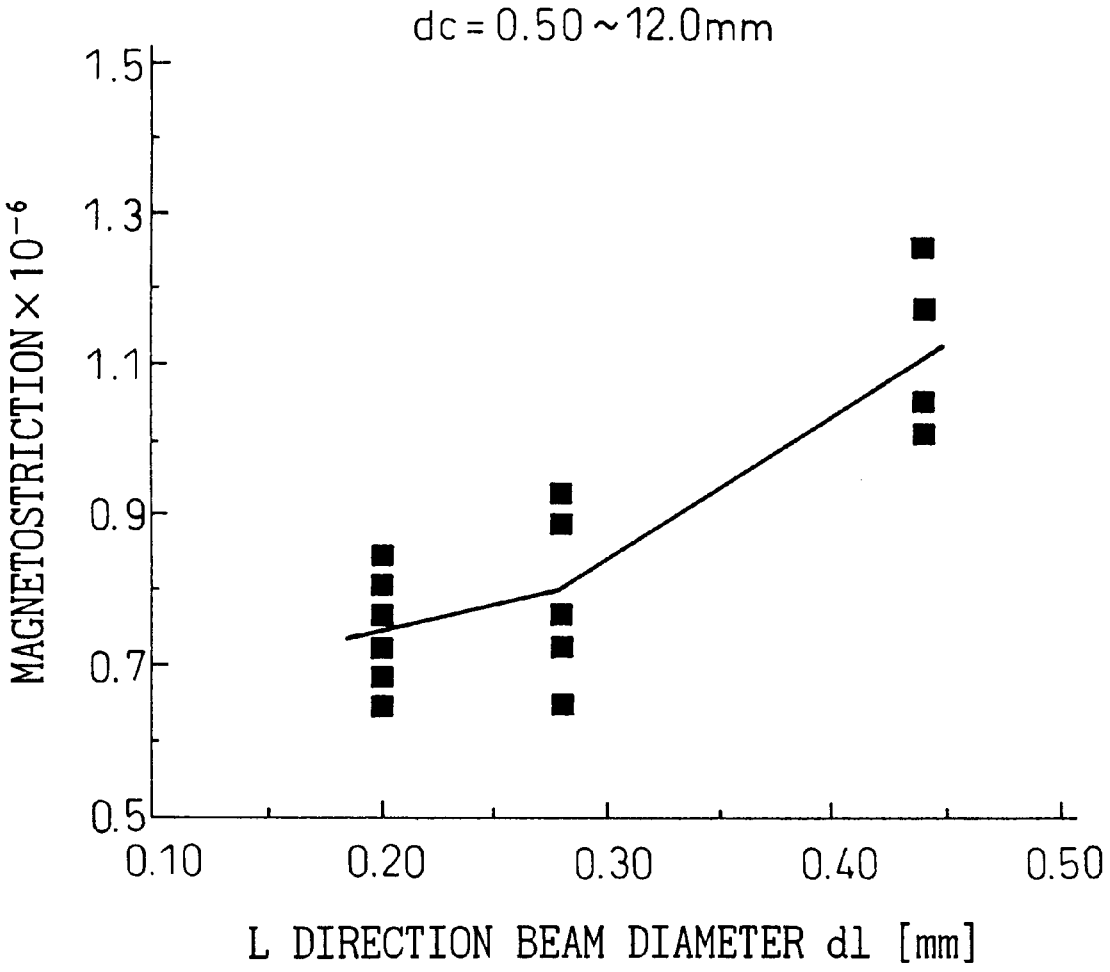
FIG. 8 is a relational graph for magnetic deformation and beam diameter in the L direction of an oval beam.

FIG. 7 and FIG. 8 are graphical summaries of the relationship between the long axis length dl and the iron loss improvement and magnetostriction, with various changes in the short axis and long axis of the oval beam, using the irradiation method of the invention. Here, a high magnetic flux density grain-oriented electrical steel sheet with a thickness of 0.23 mm was used as the irradiated material, and the irradiation conditions were: Pc=0.5 mm, Pl=6.5 mm, Fp=90 kHz, Vs=43 m/s, Ep=8.3 mJ, Pp=20 kW. FIG. 6 shows the summarized results for the relationship between iron loss improvement and dl, with dc varied in a range of 0.5–12.0 mm and dl in a range of 0.20–0.40 mm. FIG. 7 clearly shows that higher iron loss improvement can be achieved with dl in the range of 0.25–0.35 mm. This is explained as follows. Since Up increases with reduced dl under conditions of a fixed Pc according to equation (2), deformation is effectively introduced. In addition, the narrower rolling direction width of deformation and the reduced hysteresis loss also contribute to improved iron loss. This results in better iron loss improvement. However, when dl is reduced considerably the L-direction length of the deformation also decreases, thus reducing the deformation volume. Because the iron loss improvement occurs by fragmentation of the magnetic domain which is the starting point of deformation, a considerably reduced deformation volume results in a lower effect of magnetic domain fragmentation. This is believed to be responsible for the optimum point for dl as shown in FIG. 7.

FIG. 8 is a similar graph showing the relationship between dl and magnetostriction. The magnetostriction decreases linearly with smaller dl. The cause of magnetostriction is the expansion of the closure domain created when an external magnetic field is applied along the 180° magnetic domain direction, and the effect of expansion in the L direction is particularly large. Consequently, magnetostriction is lower with a narrower closure domain width in the L direction, i.e. a narrower L direction width of deformation. Thus, as shown in FIG. 8, magnetostriction is reduced with a smaller L direction width dl of the irradiated beam. Based on FIG. 7 and FIG. 8, iron loss and the magnetostriction property are both improved with dl in the range of 0.25–0.35 mm.

Figure 9:
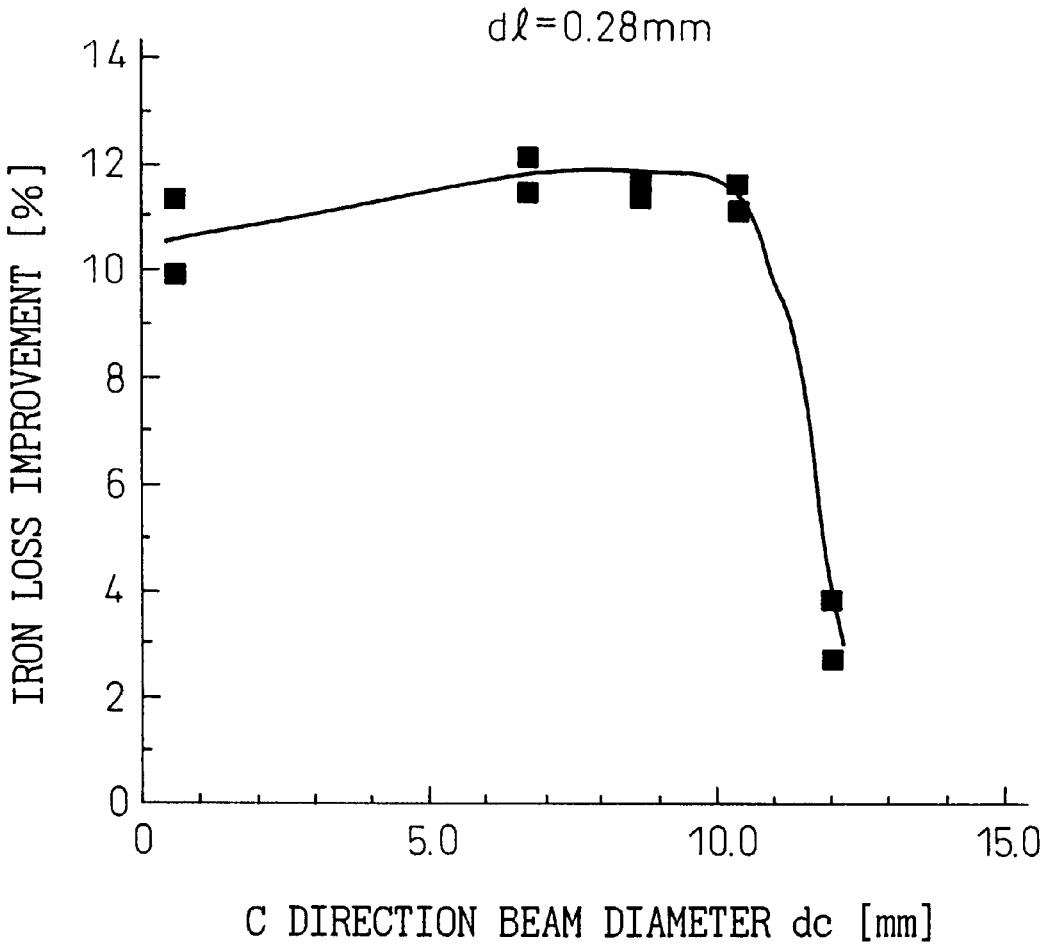
FIG. 9 is a relational graph for iron loss improvement and beam diameter in the C direction of an oval beam.
Figure 10:
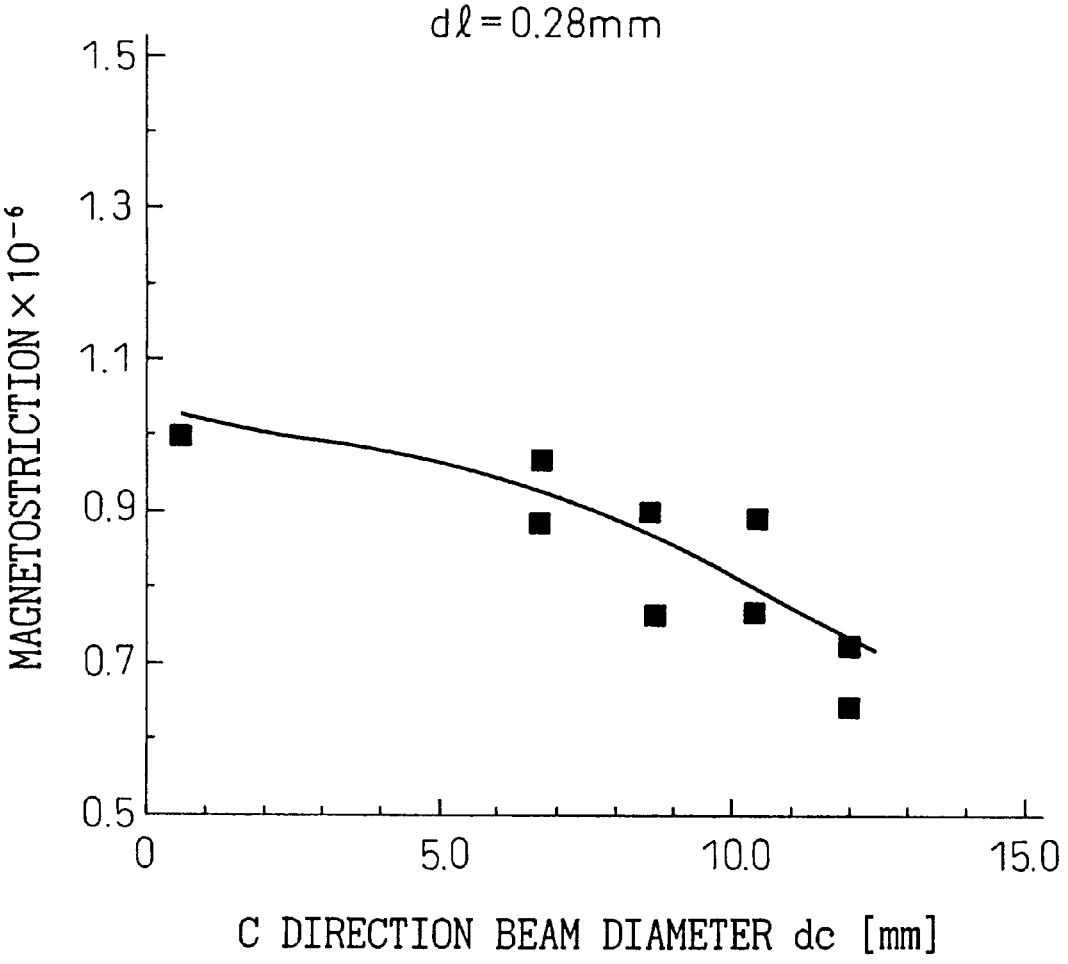
FIG. 10 is a relational graph for magnetostriction and beam diameter in the C direction of an oval beam.

The optimum value for the C direction diameter dc of the oval beam will now be discussed. FIG. 9 and FIG. 10 show the relationship between dc and the iron loss improvement and magnetostriction, with the dl fixed at 0.28 mm under the same irradiation conditions described above. According to FIG. 9, the iron loss improvement is increased by enlarging dc, and deteriorates drastically at 10 mm and greater. Laser irradiation damages were not produced with dc at 6 mm and greater. When dc was as small as about 1 mm, the peak power density Ip represented by equation (1) was higher, resulting in laser irradiation traces, but plasma was also generated on the surface of the steel sheet due to vaporization of the film. Because plasma is a laser light-absorbing medium, it reduces the laser heat input efficiency onto the steel sheet. However, with a widened dc the Ip is reduced so that virtually no plasma generation is observed. Also, since Up is constant with respect to dc in equation (2), heat input is more effectively accomplished by the degree of plasma reduction, for an increased effect of iron loss improvement. However, if dc is further increased, the energy density per single panel is markedly reduced, making it possible to accomplish sufficient heating and deformation introduction even by pulse overlay, so that less improvement in iron loss is achieved. Thus, dc is most preferably 6.0–10.0 mm from the standpoint of preventing laser irradiation damages and improving iron loss.

FIG. 10 shows that magnetostriction decreases linearly with increasing dc. This, as well, is explained by the presence or absence of plasma. If the primary heating source is direct heating by a laser, the plasma generated very near the steel sheet acts as a secondary heating source. Because the plasma has a larger area on the steel sheet surface than the laser beam diameter, the width of deformation by the plasma heat source is larger than the L direction diameter of the laser beam. As mentioned above, magnetostriction is proportional to the L direction width, and therefore magnetostriction increases due to the presence of the plasma. On the other hand, while the influence of plasma is less with a larger dc, deformation is not sufficiently introduced in a range of dc≧10 mm, as shown in FIG. 8, and thus the magnetostriction is understandably lower. Consequently, the ideal range for dc is again limited to 6.0–10.0 mm.

Figure 16A:
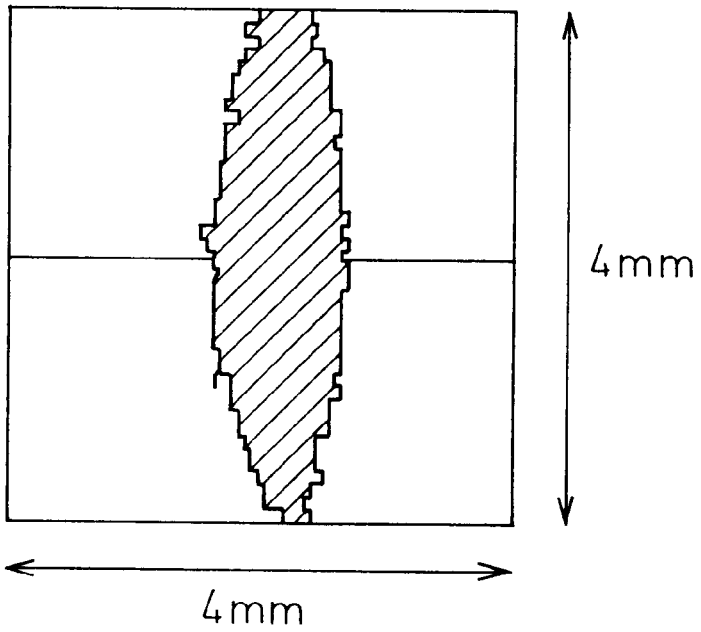
FIGS. 16(*a*) and 16(*b*) are a pair of illustrations of embodiments of beam shape control, wherein FIG. 16(*a*) shows the beam shape on a steel sheet surface with a focusing mirror of f1=375 mm and f2=200 m, with settings of Wd1=430 mm and Wdc=210 mm, and FIG. 16(*b*) shows the beam shape on a steel sheet surface using the same focusing mirror as in FIG. 16*a*, with settings of Wd1=420 mm and Wdc=207 mm.
Figure 16B:
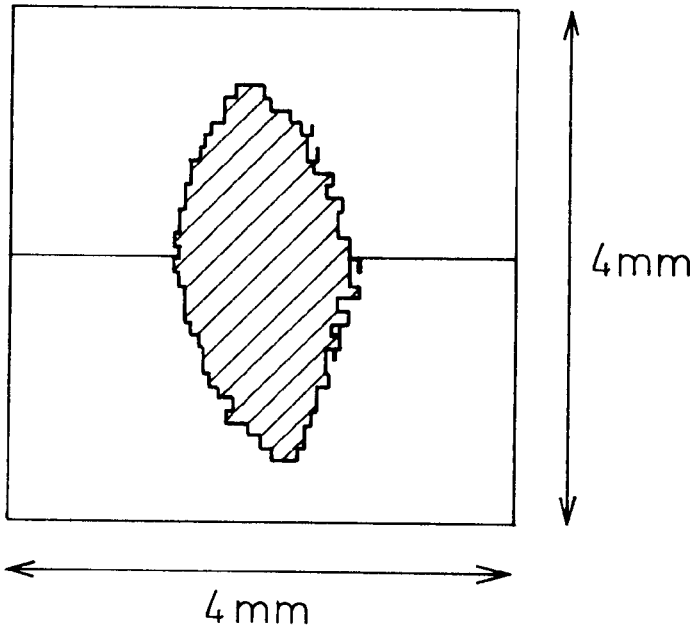

FIGS. 16(*a*) and (*b*) are illustrations showing results of measuring the beam shape for an embodiment of an apparatus of the invention where the beam shape was controlled. The laser light used here was from a continuous-wave $CO_2$ laser, and the $M^2$ value, which is a parameter indicating the focusing property of the beam, was 5.7. The incident beam diameter on the mirror 3 was about 68 mm. FIG. 16(*a*) shows the results of beam shape measurement on a steel sheet surface where a focusing mirror with f1=375 mm, f2=200 mm was situated in a focusing apparatus of the invention and the adjusting mechanisms were respectively set for Wdl=430 mm and Wdc=210 mm. These settings resulted in dl=4.3 mm for the oval long axis corresponding to the steel sheet width direction diameter, and dc=1.1 mm for the oval short axis corresponding to the rolling direction diameter.

FIG. 16(*b*) shows the results of measuring the beam shape on a steel sheet surface using the same focusing mirror, with settings of Wdl=420 mm, Wdc=207 mm by the adjusting mechanism according to the invention. These settings resulted in dl=2.9 mm and dc=1.4 mm.

With the embodiment described above it is possible to easily adjust the focused oval shape with an irradiating apparatus according to the invention, without changing the focal length of the focusing optical member.

Figure 17A:
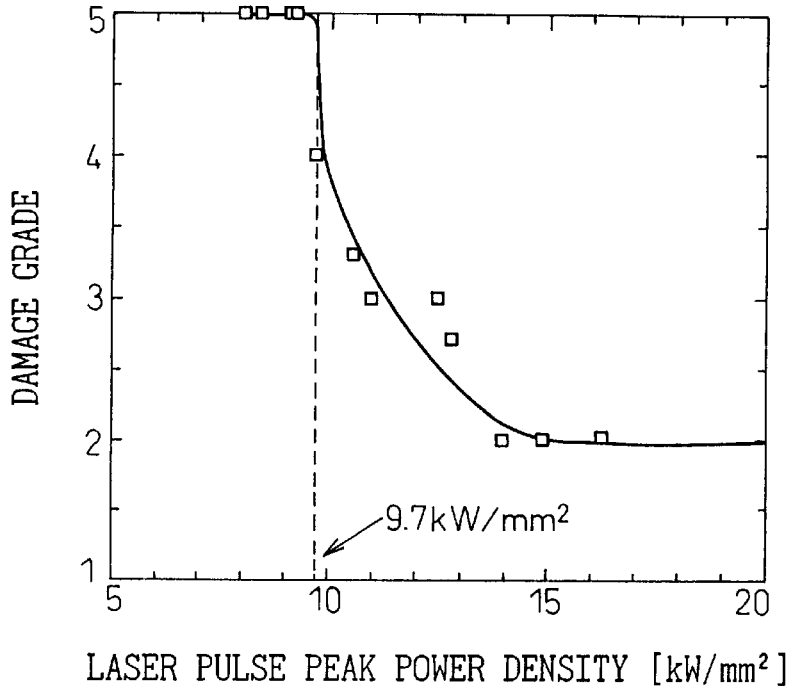
FIGS. 17(*a*) and 17(*b*) are a pair of graphs showing laser pulse peak power densities and the results of evaluating laser irradiation damages on steel sheets, wherein FIG. 17(*a*) shows the laser light resistance for steel sheet A, and FIG. 17(*b*) shows the 11 resistance for steel sheet B.
Figure 17B:
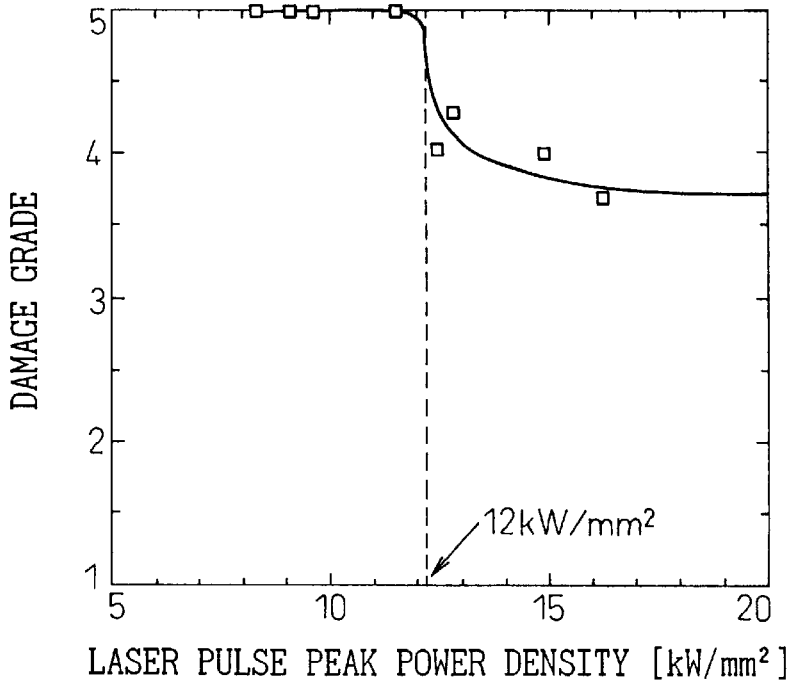

The following is an embodiment of the invention applied to an iron loss-improving apparatus for grain-oriented electrical steel sheets with minimized laser irradiation damages. FIGS. 17(*a*) and (*b*) show results from examining the laser light resistance of two different steel sheets A and B having different annealing conditions and insulating coating solutions, in a production process for high magnetic flux density grain-oriented electrical steel sheets. Here, a Q-switched pulse oscillation $CO_2$ laser was used as the laser light. The horizontal axis in FIG. 17 is the peak power density of the laser pulse, and the vertical axis is the evaluation grade (1–5) for surface irradiation damages. At an evaluation grade of 5, no visible damages were observed and no generation of rust was found in a rust acceleration test, while the surface properties were exactly the same as a material not subjected to laser irradiation. As these results clearly show, a difference in laser resistance was produced by differences in the annealing conditions and coating solution.

A steel sheet was irradiated with a beam irradiating apparatus of the invention shown in FIGS. 13 and 14, forming a beam shape which did not produce laser irradiation damages on steel sheets A and B based on the aforementioned evaluation. Table 2 shows these laser irradiation conditions and the results for iron loss improvement. The laser light used here was a Q-switched $CO_2$ laser with a beam focus parameter $M^2$ of 1.1. The incident beam diameter on the focusing mirror 3 was about 13 mm. Also, the iron loss improvement is the ratio of the difference in iron loss values before and after laser irradiation with respect to the iron loss value before laser irradiation.

TABLE 4

| Steel sheet | A | B |
|---|---|---|
| Laser average output | 1000 W | |
| Steel sheet width direction scanning speed: V | 43 m/sec | |
| Laser pulse repetition frequency: Fp | 90 kHz | |
| Steel sheet width direction irradiation pitch: P1 | 0.5 mm | |
| Rolling direction irradiation pitch: P2 | 6.5 mm | |
| Focusing mirror 3 focal length: f1 | 300 mm | |
| Focusing mirror 6 focal length: f2 | 200 mm | |
| Distance between focusing mirror 3 and steel sheet: Wdl | 541 mm | 509 mm |
| Distance between focusing mirror 6 and steel sheet: Wdc | 210 mm | 212 mm |
| Steel sheet width direction focused beam diameter: dl | 10.40 mm | 7.90 mm |
| Rolling direction focused beam diameter: dc | 0.28 mm | 0.30 mm |
| Iron loss improvement | 12.0% | 11.3% |

The results demonstrate that the present invention can consistently produce grain-oriented electrical steel sheets with improved iron loss and without surface laser irradiation damages, even with varying laser light resistances of grain-oriented electrical steel sheet surfaces.

industrial Applicability

As explained above, the method for improving iron loss of grain-oriented electrical steel sheets employing Q-switched $CO_2$ lasers according to the present invention offers the advantages of avoiding laser irradiation damages on surfaces which have been a problem with conventional pulse laser methods, and of preventing poor magnetostriction which has been a problem with continuous-wave laser methods. In addition, by limiting the focused beam shape in accordance with the laser irradiation conditions, it is possible to achieve even better magnetic properties. Finally, since a Q-switched $CO_2$ laser is used, which can give higher average output oscillation than with YAG lasers and has lower equipment and operation costs, it can be applied to high-speed, large-scale continuous processing and an effect of reduced production costs is also provided.

What is claimed is:

1. An apparatus for producing a grain-oriented electrical steel sheet with improved magnetic properties by pulse laser beam irradiation on the surface of a grain-oriented electrical steel sheet, which is an apparatus for producing a grain-oriented electrical steel sheet with excellent magnetic properties, characterized in that a focusing device in the steel sheet width direction and a focusing device in the steel sheet rolling direction are each independently provided for the irradiated laser beam, said apparatus further characterized in that adjusting mechanisms are provided for independent modification of the distances between each of said focusing devices in the steel sheet width direction and the steel sheet rolling direction, and the grain-oriented electrical steel sheet to be irradiated.

2. A process for producing a grain-oriented electrical steel sheet with improved magnetic properties by pulse laser beam irradiation on the surface of a grain-oriented electrical steel sheet, wherein said grain-oriented electrical steel sheet has a film on the surface irradiated by the pulse laser beam irradiation, which is a process for producing a grain-oriented electrical steel sheet with excellent magnetic properties characterized in that the irradiated laser beam focused shape is an oval with a long axis in the direction of the steel sheet width, the irradiation peak power density of a single focused pulse is no higher than 12 kW/mm$^2$, and the portion to be irradiated with a successive pulse laser beam is spatially overlaid for successive irradiation without said successive irradiation causing any damage to the film on said steel sheet surface.

3. A process for producing a grain-oriented electrical steel sheet with improved magnetic properties by pulse laser beam irradiation on the surface of a grain-oriented electrical steel sheet, wherein said grain-oriented electrical steel sheet has a film on the surface irradiated by the pulse laser beam irradiation, which is a process for producing a grain-oriented electrical steel sheet with excellent magnetic properties characterized in that the irradiated laser beam focused shape is an oval beam having a short axis of 0.25–0.35 mm and a long axis of 6.0–10.0 mm in the direction of the steel sheet width, the irradiation peak power density of a single laser pulse is no higher than the steel sheet surface film damage threshold value, and the portion to be irradiated with a successive pulse laser beam is spatially overlaid for successive irradiation without said successive irradiation causing any damage to the film on said steel sheet surface.

4. A process for producing a grain-oriented electrical steel sheet with improved magnetic properties achieved by a reduced 180° magnetic wall spacing with pulse laser light irradiation, wherein said grain-oriented electrical steel sheet is produced by the step of laser beam irradiation having a peak power density of a single focused pulse no higher than 12 kW/mm$^2$ so that rolling direction width of a periodic closure domain generated by laser irradiation is no greater than 150 $\mu$m, the depth of the periodic closure domain in the direction of the steel sheet thickness is at least 30 $\mu$m and the product of the length of the periodic closure domain in the rolling direction width direction multiplied by the length of the of the depth of the periodic closure domain in the direction of the steel sheet thickness is at least 4500 $\mu m^2$, wherein the magnetostriction with materials of 0.23 mm sheet thickness ($\lambda$19p-p compression) is no greater than $0.9\times10^{-6}$ wherein the magnetostriction ($\lambda$19p-p compression)is the stretch rate under 0.3 kg/mm$^2$ compression stress in a 1.9 T magnetic field.

5. A process for producing a grain-oriented electrical steel sheet with improved magnetic properties achieved by a reduced 180° magnetic wall spacing with pulse laser light irradiation, wherein said grain-oriented electrical steel sheet is produced by the step of laser beam irradiation having a peak power density of a single focused pulse no higher than 12 kW/mm$^2$ so that rolling direction width of a periodic closure domain generated by laser irradiation is no greater than 150 $\mu$m, the depth of the periodic closure domain in the direction of the steel sheet thickness is at least 30 $\mu$m and the product of the length of the periodic closure domain in the rolling direction width direction multiplied by the length of the of the depth of the periodic closure domain in the direction of the steel sheet thickness is at least 4500 $\mu m^2$, wherein the magnetostriction with materials of 0.27 mm sheet thickness ($\lambda$19p-p compression) is no greater than $1.3\times10^{-6}$ wherein the magnetostriction ($\lambda$19p-p compression)is the stretch rate under 0.3 kg/mm$^2$ compression stress in a 1.9 T magnetic field.

6. A process for producing a grain-oriented electrical steel sheet with improved magnetic properties achieved by a reduced 180° magnetic wall spacing with pulse laser light irradiation, wherein said grain-oriented electrical steel sheet is produced by the step of laser beam irradiation with an oval beam having a short axis of 0.25–0.35 mm and a long axis of 6.0–10.0 mm so that rolling direction width of a periodic closure domain generated by laser irradiation is no greater than 150 $\mu$m, the depth of the periodic closure domain in the direction of the steel sheet thickness is at least 30 $\mu$m and the product of the length of the periodic closure domain in the rolling direction width direction multiplied by the length of the depth of the periodic closure domain in the direction of the steel sheet thickness is at least 4500 $\mu m^2$, wherein the magnetostriction with materials of 0.23 mm sheet thickness ($\lambda$19p-p compression) is no greater than $0.9\times10^{-6}$ wherein the magnetostriction ($\lambda$19p-p compression) is the stretch rate under 0.3 kg/mm$^2$ compression stress in a 1.9 T magnetic field.

7. A process for producing a grain-oriented electrical steel sheet with improved magnetic properties achieved by a reduced 180° magnetic wall spacing with pulse laser light irradiation, wherein said grain-oriented electrical steel sheet is produced by the step of laser beam irradiation with an oval beam having a short axis of 0.25–0.35 mm and a long axis of 6.0–10.0 mm so that rolling direction width of a periodic closure domain generated by laser irradiation is no greater than 150 $\mu$m, the depth of the periodic closure domain in the direction of the steel sheet thickness is at least 30 $\mu$m and the product of the length of the periodic closure domain in the rolling direction width direction multiplied by the length of the depth of the periodic closure domain in the direction of the steel sheet thickness is at least 4500 $\mu m^2$, wherein the magnetostriction with materials of 0.27 mm sheet thickness ($\lambda$19p-p compression) is no greater than $1.3\times10^{-6}$ wherein the magnetostriction ($\lambda$19p-p compression) is the stretch rate under 0.3 kg/mm$^2$ compression stress in a 1.9 T magnetic field.

8. A process for producing a grain-oriented electrical steel sheet with improved magnetic properties by pulse laser beam irradiation on the surface of a grain-oriented electrical steel sheet according to any of claims 2–7 characterized in that a Q-switched $CO_2$ laser is used as said pulse laser.

* * * * *